US012235075B1

(12) United States Patent
Carlson et al.

(10) Patent No.: US 12,235,075 B1
(45) Date of Patent: Feb. 25, 2025

(54) FIREARM ACCESSORY DEVICE

(71) Applicant: Laser Aiming Systems Corporation, Maple Plain, MN (US)

(72) Inventors: Casey R. Carlson, Independence, MN (US); Brian Hedeen, Orono, MN (US)

(73) Assignee: Laser Aiming Systems Corporation, Maple Plain, MN (US)

( * ) Notice: Subject to any disclaimer, the term of this patent is extended or adjusted under 35 U.S.C. 154(b) by 230 days.

(21) Appl. No.: 17/465,839

(22) Filed: Sep. 2, 2021

Related U.S. Application Data

(63) Continuation-in-part of application No. 29/749,088, filed on Sep. 2, 2020, now Pat. No. Des. 1,035,813.

(60) Provisional application No. 63/140,174, filed on Jan. 21, 2021, provisional application No. 63/073,573, filed on Sep. 2, 2020.

(51) Int. Cl.
*F41G 1/35* (2006.01)

(52) U.S. Cl.
CPC ..... *F41G 1/35* (2013.01)

(58) Field of Classification Search
CPC ..... F41G 1/135
See application file for complete search history.

(56) References Cited

U.S. PATENT DOCUMENTS 1,898,566 A 2/1933 Albert
2,268,056 A 12/1941 Nelson et al.
2,430,469 A 11/1947 Karnes
2,773,309 A 12/1956 Elliott
2,780,882 A 2/1957 Temple
2,844,710 A 7/1958 Zinsser
2,904,888 A 9/1959 Niesp
3,112,567 A 12/1963 Flanagan
3,284,905 A 11/1966 Simmons
3,510,965 A 5/1970 Rhea
3,526,972 A 9/1970 Sumpf
3,573,868 A 4/1971 Giannetti
3,992,783 A 11/1976 Dunlap et al.
4,144,505 A 3/1979 Angelbeck et al.
(Continued)

FOREIGN PATENT DOCUMENTS

WO WO2020014641 A1 1/2020

OTHER PUBLICATIONS

AR-15LowerReceivers.com [online], "KeyMoD vs. M-LOK vs. Picatinny: AR-15 Handguards Compared," posted on Aug. 16, 2019, retrieved on Feb. 25, 2021, retrieved from URL <https://www.ar-15lowerreceivers.com/80-lower-news/keymod-vs-mlok-vs-picatinny-ar15-handguards-compared/>, 9 pages.
(Continued)

*Primary Examiner* — Thomas M Sember
(74) *Attorney, Agent, or Firm* — Christensen, Fonder, Dardi & Herbert PLLC; Andrew H. Auderieth

(57) ABSTRACT

A firearm accessory device removably attachable to a firearm. The accessary device including a laser targeting finger stop assembly for coupling to a handguard, forestock, barrel or accessory rail of a firearm. The finger stop device may include a light source, such as a laser module, and a power source housed within the device. In embodiments, the device may further include one or more activation devices operably and electrically connected to the illumination device and positioned at one or more access openings forwardly and/or rearwardly oriented in a body portion of the device.

13 Claims, 26 Drawing Sheets

(56) References Cited

U.S. PATENT DOCUMENTS 4,232,867 A 11/1980 Tate, Sr.
4,234,911 A 11/1980 Faith
4,894,941 A 1/1990 Karow, Jr.
5,208,826 A 5/1993 Kelly
5,241,146 A 8/1993 Priesemuth
5,430,967 A 7/1995 Woodman et al.
5,446,535 A 8/1995 Williams
5,448,834 A 9/1995 Huang
D368,121 S 3/1996 Lam
5,622,000 A 4/1997 Marlowe
5,822,905 A 10/1998 Teetzel
5,905,238 A 5/1999 Hung
6,185,854 B1 2/2001 Solinsky et al.
D439,628 S 3/2001 Tugwell
D439,948 S 4/2001 Fletcher
6,219,952 B1 4/2001 Mossberg et al.
6,282,829 B1 9/2001 Mossberg et al.
6,571,503 B2 6/2003 Thorpe
D487,791 S 3/2004 Freed
6,705,038 B2 3/2004 Davensport et al.
7,191,557 B2 3/2007 Gablowski et al.
7,216,451 B1 5/2007 Troy
7,243,454 B1 7/2007 Cahill
7,574,823 B2 8/2009 Nakayama
7,640,689 B2 1/2010 Fluhr
7,676,975 B2 3/2010 Phillips et al.
7,707,762 B1 5/2010 Swan
7,716,865 B2 5/2010 Daniel et al.
D616,957 S 6/2010 Rievley et al.
D619,442 S 7/2010 Chen
7,770,317 B1 8/2010 Tankersley
7,827,726 B2 11/2010 Stokes
7,836,625 B2 11/2010 Swan et al.
7,844,120 B2 11/2010 Yamamoto
7,845,105 B1 12/2010 Cahill
7,900,390 B2 3/2011 Moody et al.
7,905,041 B1 3/2011 Davies
D636,837 S 4/2011 Hughes et al.
7,938,055 B2 5/2011 Hochstrate et al.
D643,497 S 8/2011 Fitzpatrick et al.
8,001,715 B2 8/2011 Stokes
8,046,949 B1 11/2011 Daniel
8,051,595 B2 11/2011 Hochstrate et al.
8,056,277 B2 11/2011 Griffin
8,127,485 B2 3/2012 Moore et al.
8,127,486 B1 3/2012 Nelson
8,141,287 B2 3/2012 Dubois
8,141,289 B2 3/2012 Gomez et al.
8,151,504 B1 4/2012 Aiston
8,182,109 B2 5/2012 Matthews et al.
8,201,353 B1 6/2012 Swan
8,205,373 B1 6/2012 Ubl et al.
8,230,634 B1 7/2012 Davies et al.
D665,043 S 8/2012 Fitzpatrick
8,234,808 B2 8/2012 Lewis et al.
8,234,809 B2 8/2012 Daniel
8,245,428 B2 8/2012 Griffin
D668,731 S 10/2012 Fitzpatrick
D669,552 S 10/2012 Essig et al.
D669,553 S 10/2012 Hughes et al.
8,276,303 B2 10/2012 Kapusta et al.
8,276,304 B2 10/2012 Samson et al.
D670,785 S 11/2012 Fitzpatrick
8,312,665 B2 11/2012 Moore et al.
8,316,574 B1 11/2012 Swan
D672,005 S 12/2012 Hedeen et al.
8,336,243 B2 12/2012 Langevin et al.
8,347,540 B2 1/2013 Sirois
8,359,779 B2 1/2013 Daniel et al.
D678,976 S 3/2013 Pittman
8,438,769 B1 5/2013 Ghannam
8,438,770 B2 5/2013 Troy
8,448,367 B2 5/2013 Samson et al.
8,464,457 B2 6/2013 Troy et al.
8,484,882 B2 7/2013 Haley et al.
D692,517 S 10/2013 Faifer
8,578,642 B2 11/2013 Troy et al.
8,595,970 B2 12/2013 Picciotta et al.
8,607,490 B1 12/2013 Zinsner
8,607,492 B2 12/2013 Hartley et al.
D698,885 S 2/2014 Faifer
8,640,372 B2 2/2014 Hochstrate et al.
8,662,694 B1 3/2014 Izumi et al.
8,683,731 B2 4/2014 Kowalczyk et al.
8,689,477 B2 4/2014 Gomez et al.
8,689,478 B2 4/2014 Patel
8,696,150 B2 4/2014 Moore
8,707,604 B2 4/2014 Troy et al.
8,713,838 B2 5/2014 Ubl et al.
8,739,448 B2 6/2014 Kimmel et al.
8,752,322 B2 6/2014 Kresser et al.
8,769,854 B1 7/2014 Battaglia
8,789,304 B2 7/2014 Engesser et al.
8,806,792 B2 8/2014 Yan et al.
8,806,793 B2 8/2014 Daniel et al.
8,807,779 B1 8/2014 Izumi et al.
D712,499 S 9/2014 Pittman
8,819,980 B2 9/2014 Geissele
8,844,189 B2 9/2014 Moore et al.
8,904,691 B1 12/2014 Kincel
D728,054 S 4/2015 Webber
9,003,686 B2 4/2015 Brown
9,010,009 B2 4/2015 Buxton
9,032,658 B2 5/2015 Geissele
9,062,933 B1 * 6/2015 Allen ..... F21V 21/34
9,068,786 B2 6/2015 DiChario
9,068,801 B1 6/2015 Stecher, Jr. et al.
9,086,247 B2 7/2015 Lessard
9,091,505 B1 7/2015 Battaglia
9,127,906 B2 9/2015 Wells et al.
9,140,506 B2 9/2015 Gomez
9,140,520 B2 9/2015 Lopes et al.
9,157,696 B2 10/2015 Dextraze
9,157,697 B2 10/2015 Leclair
9,182,194 B2 11/2015 Moore
D745,623 S 12/2015 Flores
D745,624 S 12/2015 Flores
D745,629 S 12/2015 Barfoot et al.
D745,940 S 12/2015 Flores
9,228,798 B1 1/2016 Viola
9,228,804 B2 1/2016 Syrengelas et al.
D755,333 S 5/2016 Kielsmeier
D755,334 S 5/2016 Kielsmeier et al.
9,423,208 B1 8/2016 Mahmalji
9,453,694 B1 9/2016 Storch
9,476,672 B2 10/2016 Wells et al.
9,494,382 B2 11/2016 Storch
9,528,793 B1 12/2016 Oglesby
D779,017 S 2/2017 Liu
D783,757 S 4/2017 Jen
D785,744 S 5/2017 Bosco et al.
D786,383 S 5/2017 Saadon
D786,384 S 5/2017 Saadon
9,658,020 B2 5/2017 Daniel et al.
9,658,031 B1 5/2017 Hedeen et al.
D790,650 S 6/2017 Saadon
D790,651 S 6/2017 Saadon
9,696,111 B2 * 7/2017 Saadon ..... F41C 23/12
9,709,356 B1 7/2017 Anstett et al.
9,752,849 B2 9/2017 Anderson
9,766,035 B2 9/2017 Storch
D803,966 S 11/2017 Saadon
D803,967 S 11/2017 Saadon
D803,968 S 11/2017 Saadon
D803,969 S 11/2017 Saadon
D803,971 S 11/2017 Saadon
D804,604 S 12/2017 Shelton et al.
9,841,254 B2 12/2017 Moore
9,891,020 B2 2/2018 Jen
9,921,027 B2 3/2018 Bruhns
10,041,759 B2 8/2018 Faifer
10,060,701 B1 8/2018 Hedeen et al.
10,082,363 B2 9/2018 Burgess
D830,491 S 10/2018 Mock et al.

(56) References Cited

U.S. PATENT DOCUMENTS 10,094,635 B2 10/2018 Holmes et al.
10,132,595 B2 11/2018 Moore
D837,926 S 1/2019 Christian
10,190,840 B1 1/2019 Renteria
D841,756 S 2/2019 Saadon
10,209,030 B2 2/2019 Moore et al.
10,209,033 B1 2/2019 Moore et al.
D842,416 S 3/2019 Saadon
10,222,171 B2 3/2019 Chavez
10,260,841 B2 4/2019 Kincel et al.
10,267,594 B2 4/2019 Saadon
10,323,903 B2 6/2019 Hedeen et al.
10,365,069 B1 7/2019 Tayon et al.
D860,375 S 9/2019 Chavez
10,436,538 B2 10/2019 Moore et al.
10,436,553 B2 10/2019 Moore et al.
10,443,978 B2 10/2019 Kowalczyk, Jr. et al.
D865,902 S 11/2019 Storch
D873,369 S 1/2020 Shelton et al.
D873,372 S 1/2020 Shelton
D873,946 S 1/2020 Hedeen et al.
10,532,275 B2 1/2020 Moore
D876,570 S 2/2020 Saadon
D898,153 S 10/2020 Podgurny
D904,546 S 12/2020 Cheng
D915,541 S 4/2021 Chavez
11,112,217 B1 * 9/2021 Neel ..... F41G 1/35
2001/0042335 A1 11/2001 Strand
2002/0009694 A1 1/2002 Rosa
2002/0057719 A1 5/2002 Shechter
2002/0073561 A1 6/2002 Liao
2002/0129536 A1 9/2002 Lafrate et al.
2002/0134000 A1 9/2002 Varshneya et al.
2003/0226305 A1 * 12/2003 Burnett ..... F41G 3/165
42/90
2004/0003529 A1 1/2004 Danielson
2004/0244259 A1 12/2004 Davenport et al.
2005/0130739 A1 6/2005 Argentar
2006/0204835 A1 9/2006 Kelsey et al.
2006/0260169 A1 11/2006 Samson et al.
2007/0039226 A1 2/2007 Stokes
2007/0261285 A1 11/2007 Troy
2009/0122527 A1 * 5/2009 Galli ..... F41G 11/003
362/110
2009/0178325 A1 7/2009 Veilleux
2010/0178540 A1 7/2010 Kelsey et al.
2010/0212201 A1 8/2010 Kincel et al.
2010/0229448 A1 9/2010 Houde-Walter et al.
2010/0269392 A1 10/2010 Swan
2010/0319231 A1 12/2010 Stone et al.
2011/0047850 A1 3/2011 Rievley et al.
2011/0047851 A1 3/2011 Mock et al.
2011/0061281 A1 3/2011 Kapusta et al.
2011/0074303 A1 3/2011 Stokes
2011/0107643 A1 5/2011 Fitzpatrick et al.
2011/0126443 A1 6/2011 Sirois
2011/0138667 A1 6/2011 Bolden
2011/0214327 A1 9/2011 Desomma
2011/0252681 A1 10/2011 Houde-Walter et al.
2012/0144716 A1 6/2012 Cabahug
2012/0144718 A1 6/2012 Danielson
2012/0198990 A1 8/2012 Brittin
2012/0317859 A1 12/2012 Brown
2013/0180151 A1 7/2013 Moore
2013/0185978 A1 7/2013 Dodd
2013/0219765 A1 8/2013 Ibarguren
2013/0276341 A1 10/2013 Wells et al.
2013/0284008 A1 10/2013 Pizano
2014/0007485 A1 1/2014 Castejon, Sr.
2014/0026459 A1 1/2014 Yan et al.
2014/0033590 A1 2/2014 Gomez
2014/0075817 A1 3/2014 Gomez
2014/0076150 A1 3/2014 Brinkmeyer et al.
2014/0109457 A1 4/2014 Speroni
2014/0130390 A1 5/2014 Geissele
2014/0196342 A1 7/2014 Syrengelas et al.
2014/0355258 A1 12/2014 Izumi et al.
2015/0131269 A1 * 5/2015 Franklin ..... F41G 11/001
362/110
2015/0135573 A1 5/2015 DiChario
2015/0184978 A1 7/2015 Hedeen et al.
2015/0233668 A1 8/2015 Moore
2015/0247695 A1 9/2015 Jarboe
2015/0316347 A1 11/2015 Shea et al.
2016/0061560 A1 3/2016 Saadon
2016/0091276 A1 3/2016 Miller et al.
2016/0178319 A1 6/2016 Grace, Jr. et al.
2016/0195366 A1 7/2016 Kowalczyk et al.
2016/0245617 A1 8/2016 Moore
2016/0290760 A1 10/2016 Jen
2017/0082399 A1 3/2017 Moore et al.
2017/0097208 A1 4/2017 Hebden et al.
2017/0138701 A1 5/2017 Kowalczyk, Jr. et al.
2017/0155269 A1 6/2017 Swift
2017/0184374 A1 6/2017 Kowalczyk, Jr. et al.
2018/0058805 A1 3/2018 Mock et al.
2018/0106568 A1 4/2018 Hedeen et al.
2018/0172401 A1 6/2018 Mock et al.
2018/0172402 A1 6/2018 Tuller et al.
2018/0238649 A1 8/2018 Winiecki
2018/0292170 A1 10/2018 Gagliano et al.
2018/0299217 A1 10/2018 Hedeen et al.
2018/0321015 A1 11/2018 Hedeen et al.
2019/0041045 A1 2/2019 Mock et al.
2019/0063864 A1 2/2019 Stewart et al.
2019/0222771 A1 7/2019 Hedeen et al.
2019/0376762 A1 12/2019 Saadon

OTHER PUBLICATIONS thefirearmblog.com [online], "Friday Night Lights: Viridian HS1 Finger Stop Laser," posted on Sep. 11, 2020, retrieved on Jun. 7, 2023, retrieved from URL <https://www.thefirearmblog.com/blog/2020/09/11 /hs 1-finger-stop/>, 11 pages.

* cited by examiner

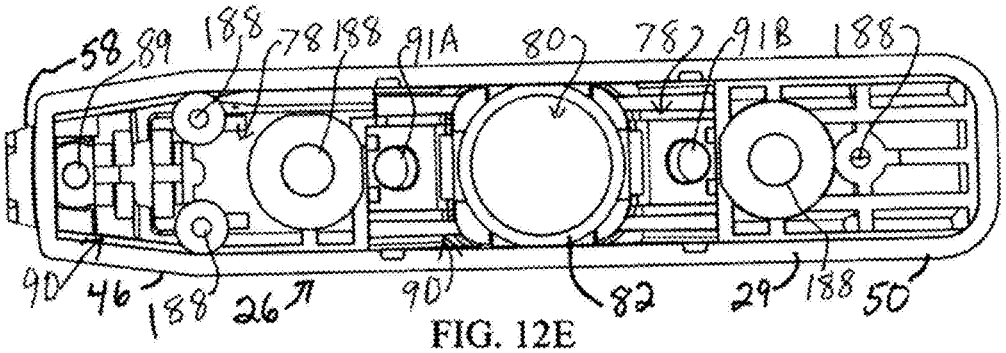
FIG. 12E
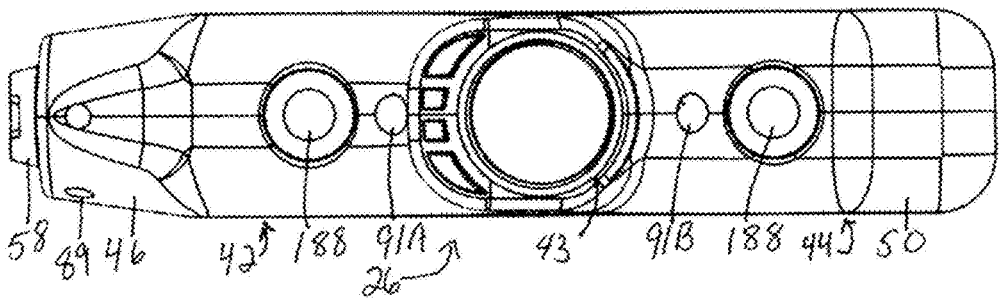
FIG. 12F
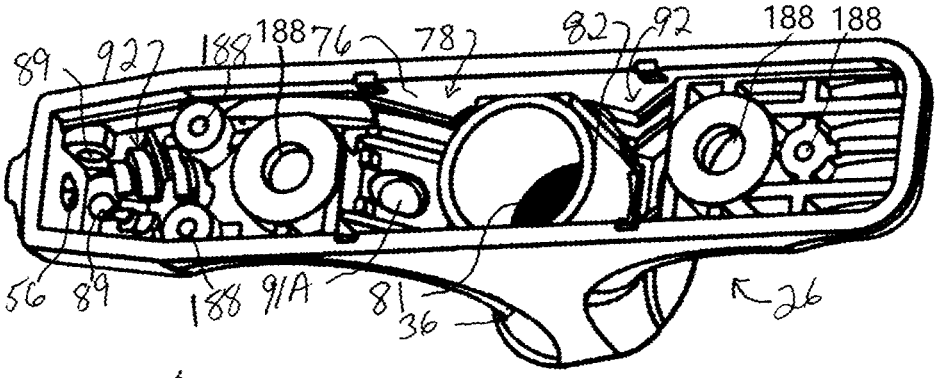
FIG. 12G1
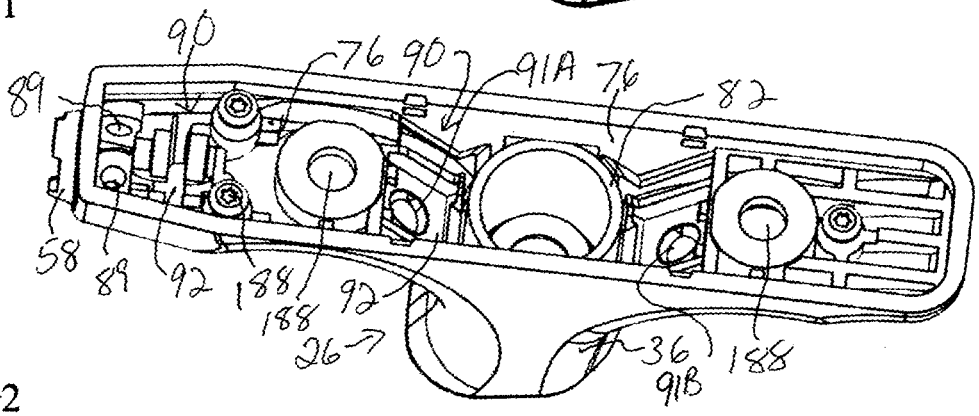
FIG. 12G2

FIREARM ACCESSORY DEVICE

CROSS-REFERENCE TO RELATED APPLICATIONS

This application claims the benefit of U.S. Provisional Application No. 63/073,573, filed Sep. 2, 2020, and of U.S. Provisional Patent Application No. 63/140,174, filed Jan. 21, 2021, and is a continuation-in-part of U.S. Design patent application Ser. No. 29/749,088, filed Sep. 2, 2021, all of which are incorporated herein by reference in their entireties.

FIELD OF THE DISCLOSURE

The present disclosure relates to firearm accessory devices for mounting on a firearm, in particular, a laser targeting finger stop for coupling to a firearm.

BACKGROUND

Many firearms, particularly rifles, are controlled with the non-firing hand receiving a hand guard surrounding the firearm barrel. Grasping the firearm can be awkward and uncomfortable for users, particularly in extended firing sessions. Standardized mounting rails have made it possible to mount a wide variety of accessories to a firearm. Weapon-mounted firearm accessories have become an important tool for military, police, and civilian firearm users. Presently, many shooters utilize different accessories to enhance their firearm and provide additional functionality which allows for improved firearm utilization. One such accessory is the firearm foregrip. A firearm foregrip is typically attached onto a handguard rail via different mechanisms and vertically oriented or angled. Foregrips usually include an elongated handle that can be gripped by the hand not operating the trigger. Such conventional firearm foregrips may provide additional support and control, they can however become uncomfortable and awkward for users, particularly in extended firing sessions. Any improvements with respect to ergonomic functionality and the ability to employ different support hand holding techniques would be welcome.

In one or more embodiments, the accessory devices disclosed herein are further advantageous in that they include ergonomic features configured to maximize user comfort, accuracy and safety.

SUMMARY

The present disclosure relates to firearm accessory devices for mounting on a firearm, in particular, a laser targeting finger stop device for coupling to a handguard, forestock, barrel or accessory rail of a firearm. In one or more embodiments, a finger stop device that may be attached to a firearm, the device including a light source, such as a laser module, and a power source housed within the device. In embodiments, the device may further include one or more activation devices operably and electrically connected to the illumination device and positioned at one or more access openings forwardly and/or rearwardly oriented in a body portion of the device.

In one or more embodiments, there is disclosed herein a finger stop device for a firearm. In embodiments, the device may include a housing removably attachable to the firearm, wherein the housing includes a body portion downwardly extending from a cover portion and including a trunk portion and forward and rearward portions oppositely extending from an upper portion of the trunk portion. In embodiments, the forward and rearward portions each may have a tapered neck portion between the trunk portion and a forward end portion and a rearward end portion.

In one or more embodiments, the device may further include an aperture formed in the forward end of the housing, an illumination device positioned within the housing and configured to emit light through the aperture and a first activation device. In embodiments, the first activation device and the forward, rearward and trunk portions may each intersect a common plane. The first activation device may be accessible from outside of the housing, through the wall of the body portion, and be operably (electrically) connected to the illumination device and a power supply, wherein engagement with the first activation device directs power from the power supply to the illumination device. In one or more embodiments, the illumination is a laser module and the device further includes a coupling mechanism for coupling the housing to the firearm.

In one or more embodiments, the first activation device at least partially extends through a first opening in the housing wall of the body portion at an acute angle between the housing axis and a line through and perpendicular to the first opening. In embodiments, the acute angle may be in the range of about 35 degrees to about 55 degrees. In some embodiments, the acute angle may be in the range of about 41.35 degrees to about 46.00 degrees, and in one or more embodiments, the acute angle is about 43.68 degrees.

In one or more embodiments, the device includes a second activation device accessible from outside of the housing, through the wall of the body portion, wherein the second activation device is operably (electrically) connected to the illumination device and a power supply. In embodiments, engagement with the second activation device directs power from the power supply to the illumination device. In embodiments, the second activation device and the forward, rearward and trunk portions may each intersect a common plane.

In one or more embodiments, the second activation device at least partially extends through a second opening in the housing wall of the body portion at an acute angle between the housing axis and a line through and perpendicular to the second opening. In embodiments, the acute angle may be in the range of about 34 degrees to about 44 degrees. In some embodiments, the acute angle may be in the range of about 31 degrees to about 37 degrees, and in one or more embodiments, the acute angle is about 34 degrees.

In embodiments, the illumination device may be a laser module. The common plane may further approximately vertically bisects the device and the illumination device and aperture each intersect the common plane. In one or more embodiments, the housing includes structure within the wall, wherein the structure defines compartments, chambers, mounts and/or seats for containing electronic components and a power source. In some embodiments, the structure is integral with the housing wall.

In one or more embodiments, the device includes a trunk portion vertically oriented between an upper portion and a lower portion, a forward extending portion having a forward end portion and a neck portion and a rearward extending portion having a rearward end portion and a neck portion. The neck portions may be positioned between the forward and rearward end portions and the upper trunk portion, wherein, in a side profile view, the housing forms a first forward arc between the forward end portion and the trunk portion. The first forward arc has a positive curvature along its arc length relative to a forward center of curvature.

In embodiments, the device may further have a first rearward arc in a side profile view of the housing. The first rearward arch is formed between the rearward end portion and the trunk portion and has a positive curvature along its arc length relative to a first rearward center of curvature. In embodiments, the device may include a second reward arc, reward of the first rearward arch. The second rearward arc has a positive curvature along its arc length relative to a third center of curvature.

In one or more embodiments, the accessory devices disclosed herein are further advantageous in that they include ergonomic features configured to maximize user comfort, accuracy and safety.

The above summary is not intended to describe each illustrated embodiment or every implementation of the present disclosure.

BRIEF DESCRIPTION OF THE SEVERAL VIEWS OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

FIG. 21 depicts a bottom plan view of the device of FIG. 2A, according to one or more embodiments of the disclosure.

FIG. 12E depicts a top plan view of the body portion of FIG. 12A, according to one or more embodiments of the disclosure.

FIG. 12F depicts a bottom plan view of the body portion of FIG. 12A, according to one or more embodiments of the disclosure.

FIGS. 12G1-12G2 are left-side top perspective views of the body portion of FIG. 12A, according to one or more embodiments of the disclosure.

Figure 1:
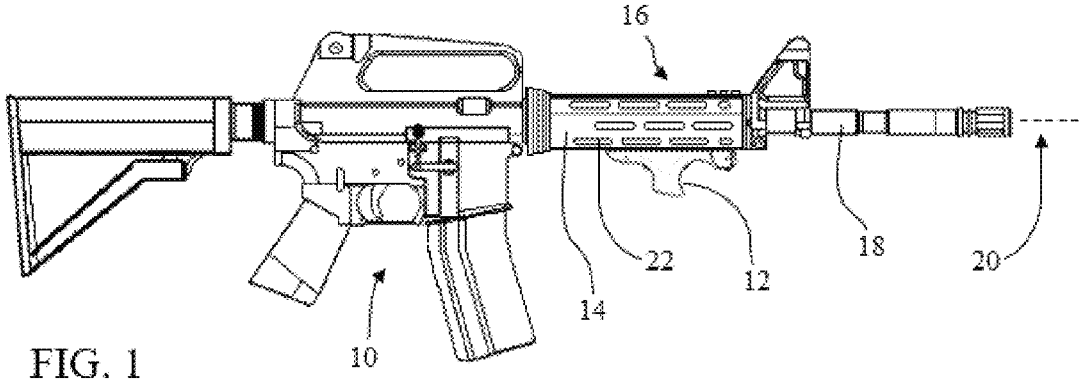
FIG. 1 depicts a side elevation view of a firearm with an accessory device attached thereto, according to one or more embodiments of the disclosure.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring to FIG. 1, a side view of a firearm 10 with an attached accessory device 12 is depicted, in accordance with one or more embodiments of the disclosure. In one or more embodiments, the firearm 10 may include, among other various components, a rail interface system comprising a handguard 14 mounted on a forend portion 16 of the firearm 10 and a barrel 18 extending therethrough along a bore axis 20. In embodiments, surrounding the handguard 14 are a plurality of elongated open slots 22 in the handguard 14 and a void space between the handguard 14 and the barrel 18. In one or more embodiments, as shown in FIG. 1, accessory device 12 may be coupled to one or more of the elongated open slots 22 at the bottom of the handguard 14.

In embodiments, the accessory device 12, as illustrated in FIG. 1, may be mounted and secured to a firearm using a rail interface system of the M-LOK "negative space" design. However, in embodiments, accessory device 12 may be mounted and secured to a firearm using various known rail interface systems configured to accommodate a variety of different accessories and attachments. As such, the firearm 10 and interface system depicted in FIG. 1 is meant for illustrative purposes and not meant to be limiting. While the accessory device 12 is shown as attached to a specific location of the handguard 14, it may be attached to other attachment points on the firearm 10.

Referring to FIGS. 2A-21, various views of a firearm accessory device 12 are depicted, in accordance with one or more embodiments of the disclosure. FIG. 3, a cross-sectional view of device 12 along bisecting plane A-A of FIG. 2H, and FIG. 4, an exploded left side view of device 12, illustrate assembly and positioning of various components of device 12 in accordance with one or more embodiments of the disclosure.

As shown in FIGS. 2A-21, in one or more embodiments, the device 12 has a length 200 extending from a forward end 28 to a rearward end 30 and includes a body portion 26 and a cover portion 32, the cover portion 32 being coupled to an upper portion 34 of the body portion 26. Alternatively, or additionally, the cover portion 32 is uniform with the body portion 26. In one or more embodiments, the body portion 26 includes an upper rim 27 defining an upper opening 31, wherein the upper rim 27 may form an upper rim surface 29. In embodiments, the cover portion 32 includes an upper face portion 33 and extends from a forward portion 35 to a rearward portion 37 between or to the forward and rearward ends 28, 30, of the device 12.

In one or more embodiments, the body portion 26 includes a middle or trunk portion 36, a forward portion 42 forwardly extending from the trunk portion 30 and a rearward portion 44 rearwardly extending from the trunk portion 36. The trunk portion 36 may include an upper body portion 38, a lower body portion 40 and right and left side portions 39, 41. In embodiments, the lower body portion 40 may include a lower rim 43 defining a lower opening 45. Device 12 may further include a lower or distal cap 83 coupled to lower body portion 40 and covering lower opening 45.

In one or more embodiments, the forward portion 42 includes a forward end portion 46 and a first or forward tapered or neck portion 48 positioned between the forward end portion 46 and the trunk portion 36. The rearward portion 44 may include a rearward end portion 50 and a second tapered or neck portion 52 positioned between the rearward end portion 50 and the trunk portion 36.

In one or more embodiments, the forward end portion 46 may include a forward-facing aperture 56 and an outer collar 58 framing the aperture 56. In embodiments, aperture 56 provides an outlet for illumination emitted from an illumination device disposed within the body portion 26. In one or more embodiments, device 12 includes a laser module producing a laser sight, wherein, when activated, the produced laser beam is emitted through aperture 56.

Device 12, in one or more embodiments, further includes a plurality of access portions or openings 88 located in access positions on/in the device 12. The plurality of access portions or openings 88 may comprise one or more activator/actuator access portions or openings 91 and one or more adjustment access portions or openings 89 located in. Such access portions may be formed or included in the body portion 26.

In one or more embodiments, device 12 includes one or more activation elements/components 60 and one or more adjustment elements/components 62. In the embodiment shown in FIGS. 2A-4, device 12 includes a forward oriented activation component 60 accessible via a forward oriented activator access portion 91, which may be an opening. The embodiment shown includes an activation component 60 having a forward activator or actuator 162, wherein a protrusion portion 163 of the forward activator 162 protrudes or is accessible through activator access opening 91. In embodiments, forward activator 162 may be used, by engaging, depressing or otherwise triggering, for activating one or more electronic components of device 12.

In one or more embodiments, device 12 includes one or more adjustment elements 62, which may include, for example, windage and elevation adjustment devices, such as, for example, alignment pins or screws. As illustrated in FIGS. 2A-4, in one or more embodiments, adjustment elements 62, accessible via adjustor access portions or openings 89, may be positioned on the forward end portion 46 and perpendicularly oriented relative to one another. In embodiments, the adjustment elements 62 include a side windage adjustment device and a bottom elevation adjustment device, each being configured to be adjusted by rotation of the device.

In embodiments, the adjustment devices may be configured to be adjusted using an appropriately sized tools, including, for example, an allen wrench, and/or by hand via an incorporated knob, handle, button, or the like. In one or more embodiments, windage is adjusted by rotating the side windage adjustment device clockwise and counter-clockwise and elevation is adjusted by rotating the bottom elevation adjustment device clockwise and counter-clockwise. In one or more embodiments, device 12 includes a laser module producing a laser sight and adjustment elements 62 are laser sight adjustment elements, wherein windage for the laser sight is adjusted by rotating the side windage adjustment device clockwise and counter-clockwise and elevation for the laser sight is adjusted by rotating the bottom elevation adjustment device clockwise and counter-clockwise.

In one or more embodiments, adjustment elements 62, include set screws, windage and elevation screws, that provide aiming adjustments with respect to the barrel axis of a laser beam projected by the laser diode for windage and elevation. In embodiments, adjustment elements 62 may include dog point set screws or #4-48×3/16 oval tip-centerless ground set screws. In one or more embodiments, device 12 may further include a spring element 65, for example, a compression spring and a grommet, i.e. rubber grommet, used in adjustment of the laser 104.

In one or more embodiments, device 12 may further include a pattern of raised portions 96 on the outer surface 74 of body portion 26. Raised portions 96 may provide increased traction and a more tactile feel, enhancing the user's engagement with the device 12. In embodiments, raised portions 96 may define various geometric shapes, including, for example, lines, circles and polygons. In embodiments, raised portions 96 may be formed as an integral portion of the body portion 26. In one or more embodiments, raised portions 96 may be formed of a resilient elastomeric material.

In one or more embodiments, device 12 further includes a mounting assembly 64 that may be used for coupling device 12 to a firearm accessory rail or handguard 14 and maintaining device 12 in a select position relative to the rail or handguard 14. In one or more embodiments, the mounting assembly 64 illustrated is configured to couple to a rail interface system utilizing a firearm accessory rail or handguard 14, as illustrated in FIG. 1, that includes a plurality of elongated slots 22.

In the embodiment illustrated FIGS. 2A-4, mounting assembly 64 may comprise a locking mechanism 67 comprising one or more fastener assemblies 68 that may work in conjunction with one or more mounting interfaces 66 disposed or formed on the upper face portion 33 of cover 32. Each fastener assembly 68 may comprise a mounting fastener 69 and a mounting bolt 71. As an example, the fastener 69 may be a T-nut or a M-LOK Nut. In embodiments, mounting bolts 71 may be sized and configured to extend from the body portion 26 through an opening in the upper face 33 of the upper cover portion 32. In one or more embodiments, fasteners 69 are received, along with mounting interface 66, through open slots 22 in the handguard 14 into voids between the handguard 14 and the barrel 18 to both clamp the fastener assemblies 68 to the handguard 14 and further to prevent movement of the device 12 on the firearm 10.

In an embodiment, mounting fasteners 69 are configured to rotate ninety degrees) (90° between a locked position (in which aligns with the slot and can pass through the slot) and an unlocked position (in which it extends across the slot) to facilitate coupling the firearm accessory to the firearm accessory rail. The mounting bolt 71 is rotatably coupled to the mounting fastener 69 for rotating the mounting fastener 69 between the locked position and the unlocked position. In an embodiment, the locking mechanism 67 includes a pair of fastener assemblies 68. In another embodiment, the locking mechanism 67 may include any suitable number of fastener assemblies 68 to couple the firearm accessory device 12 to the firearm 10 and/or the firearm accessory rail or handguard. In an embodiment, the mounting assembly 64 may be a Magpul M-Lock compatible system (MLOK system) having standardized mounting interface and fasteners.

Figure 2A:
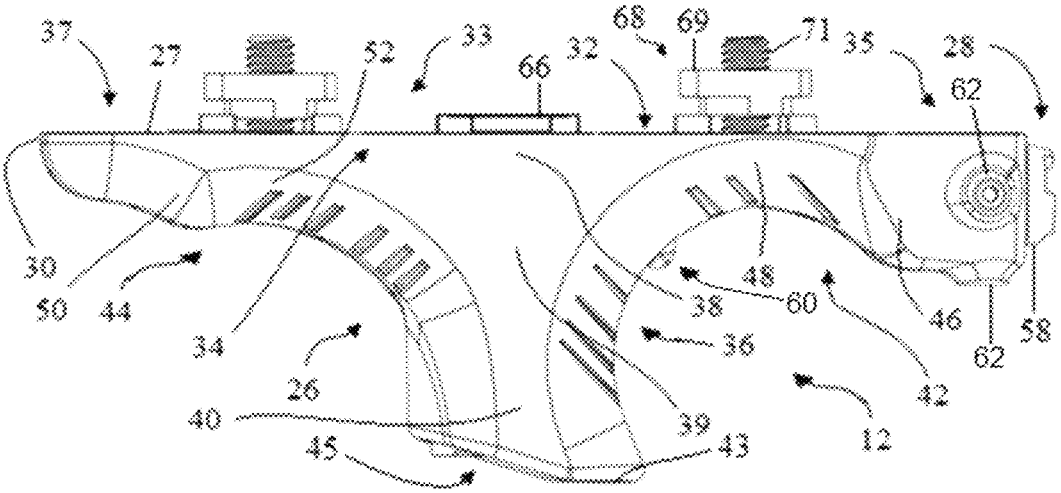
FIG. 2A depicts a right-side elevation view of an accessory device, according to one or more embodiments of the disclosure.
Figure 2B:
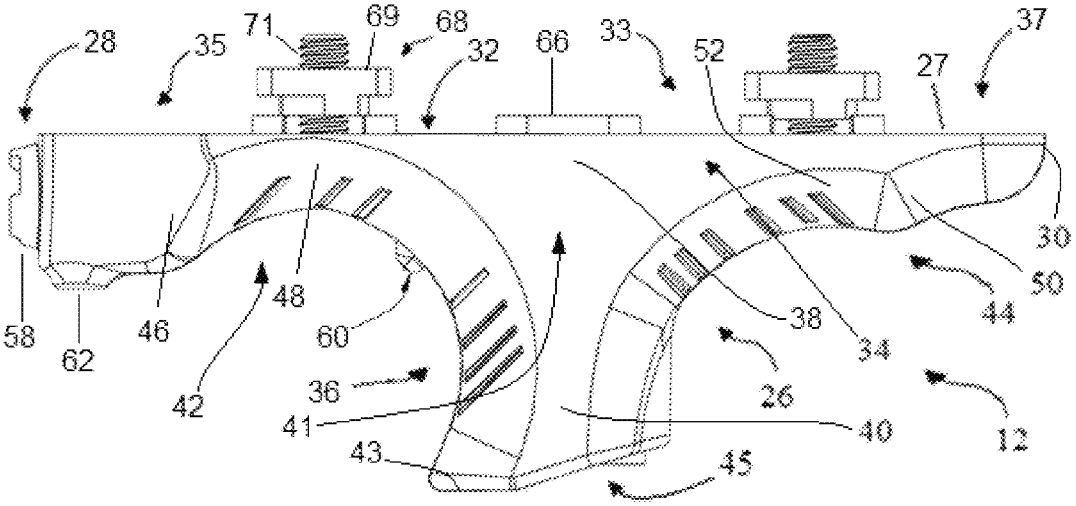
FIG. 2B depicts a left-side elevation view of the device of FIG. 2A, according to one or more embodiments of the disclosure.
Figure 2C:
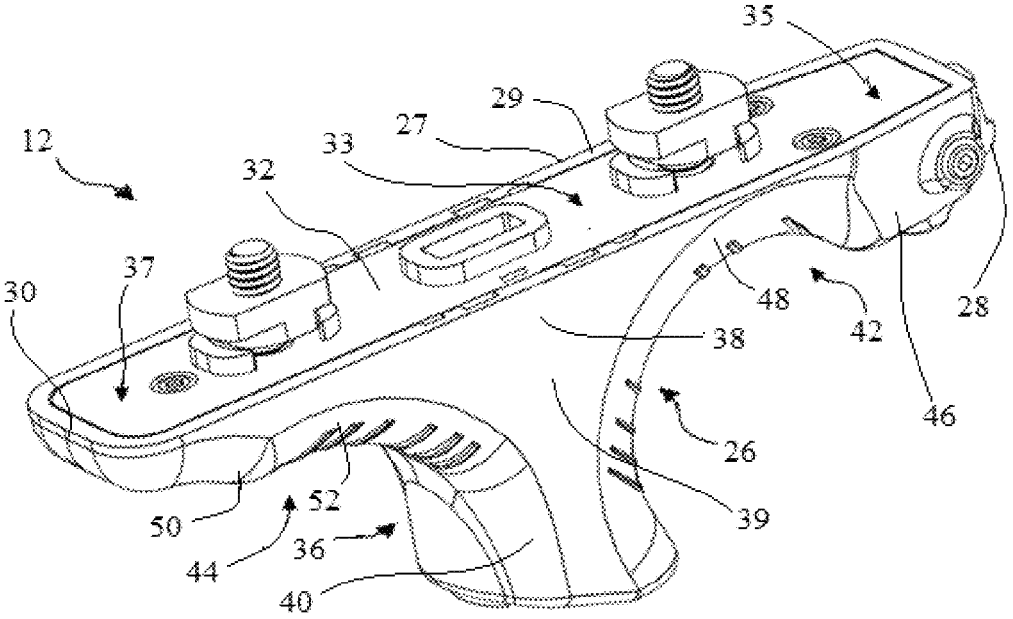
FIG. 2C depicts a right-side, top, rear perspective view of the device of FIG. 2A, according to one or more embodiments of the disclosure.
Figure 2D:
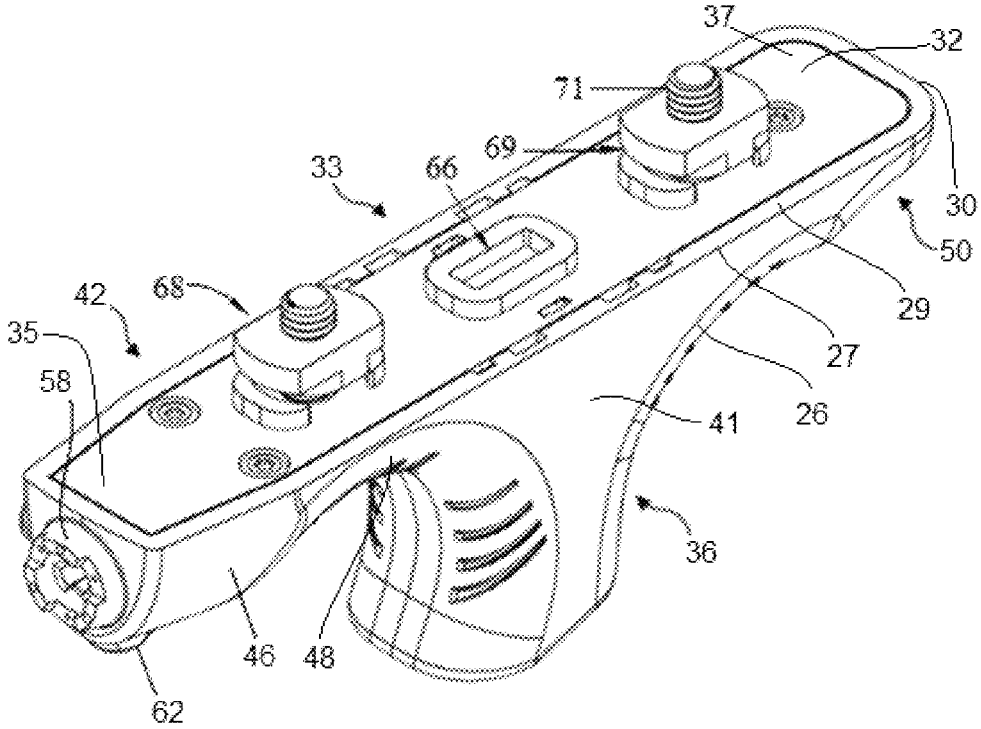
FIG. 2D depicts a left-side, top, front perspective view of the device of FIG. 2A, according to one or more embodiments of the disclosure.
Figure 2E:
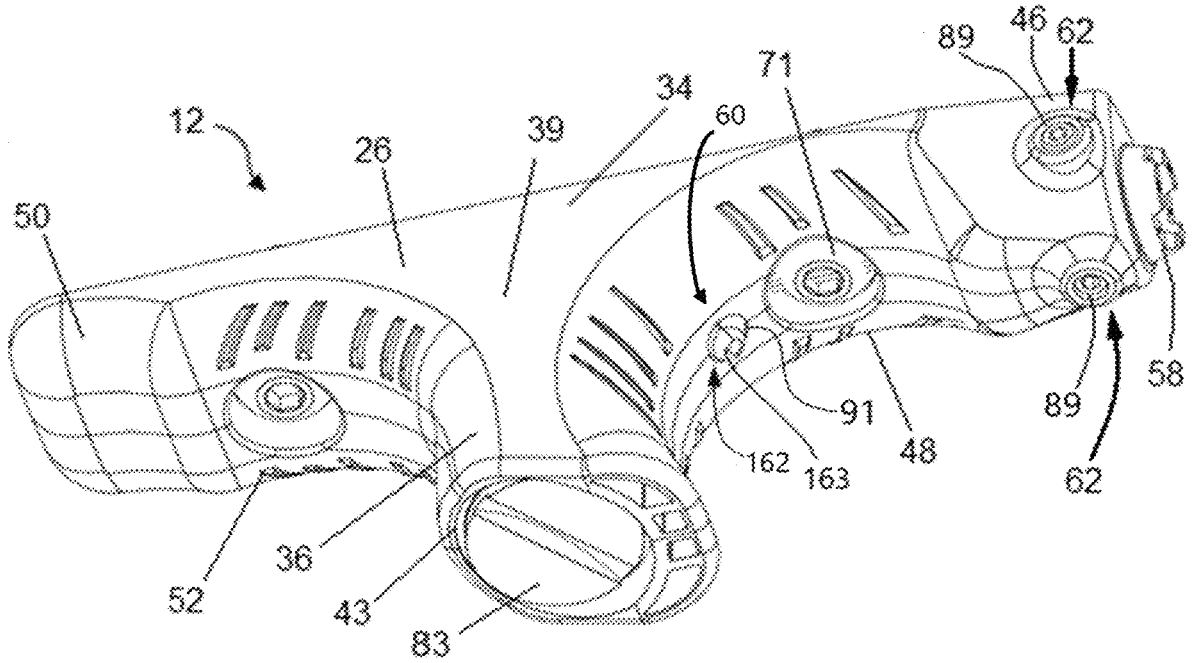
FIG. 2E depicts a right-side, bottom perspective view of the device of FIG. 2A, according to one or more embodiments of the disclosure.
Figure 2F:
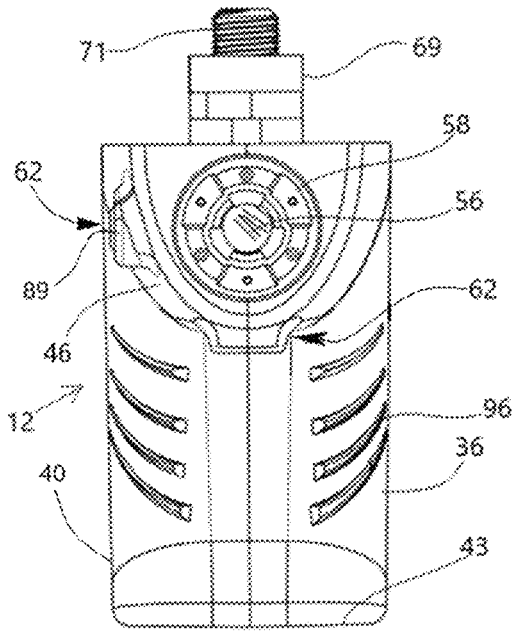
FIG. 2F depicts a front view of the device of FIG. 2A, according to one or more embodiments of the disclosure.
Figure 2G:
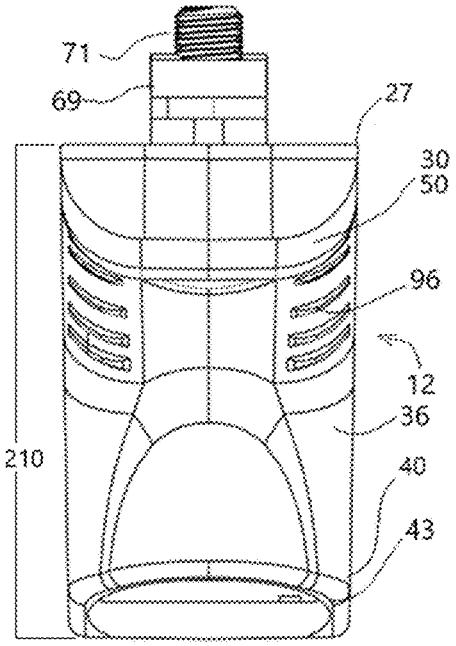
FIG. 2G depicts a rear view of the device of FIG. 2A, according to one or more embodiments of the disclosure.
Figure 2H:
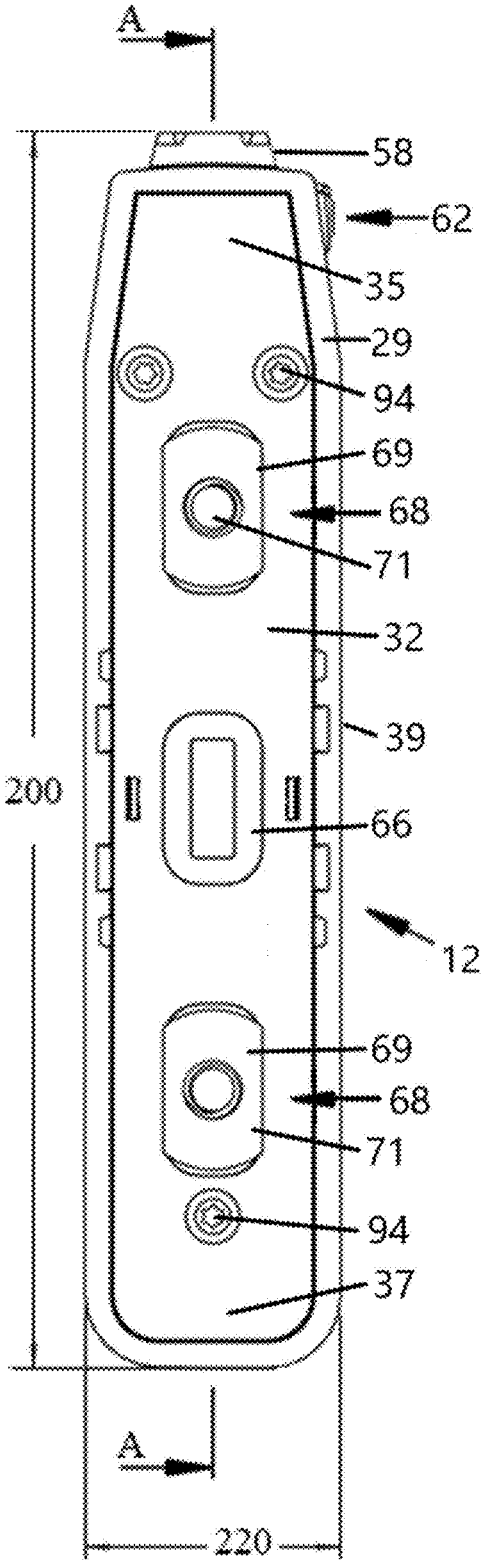
FIG. 2H depicts a top plan view of the device of FIG. 2A, according to one or more embodiments of the disclosure.
Figure 2I:
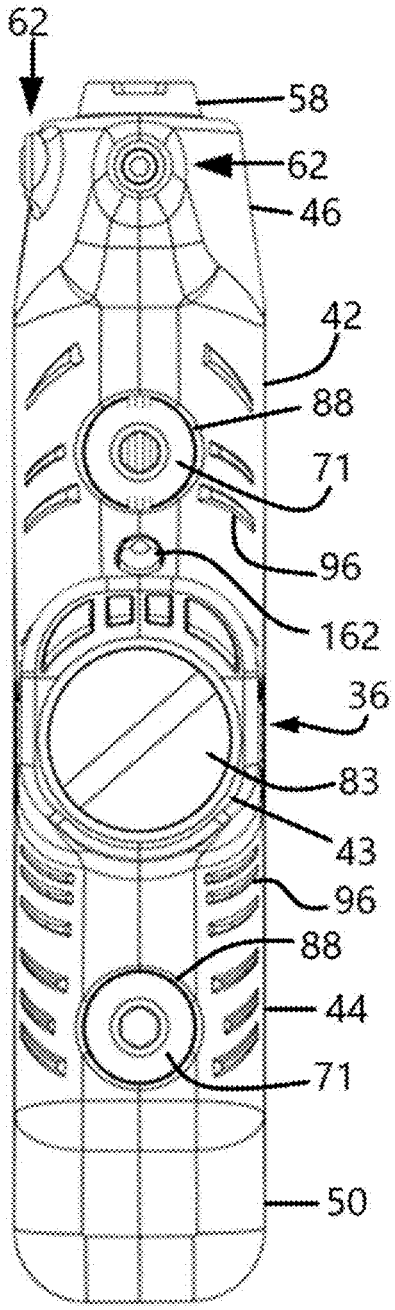
Figure 3:
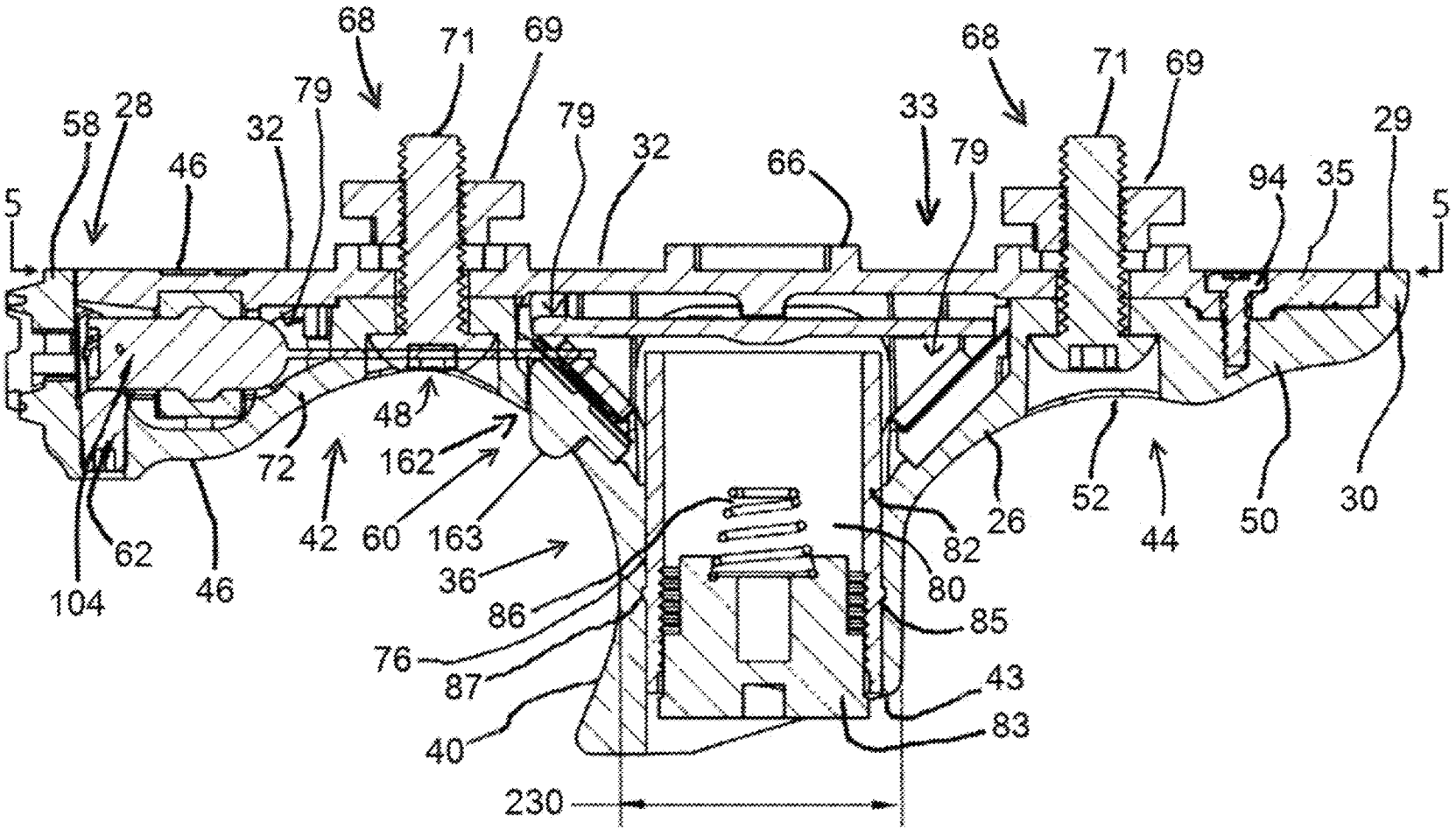
FIG. 3 depicts a cross-sectional view of the device of FIG. 2A at line A-A of FIG. 2H, according to one or more embodiments of the disclosure.
Figure 4:
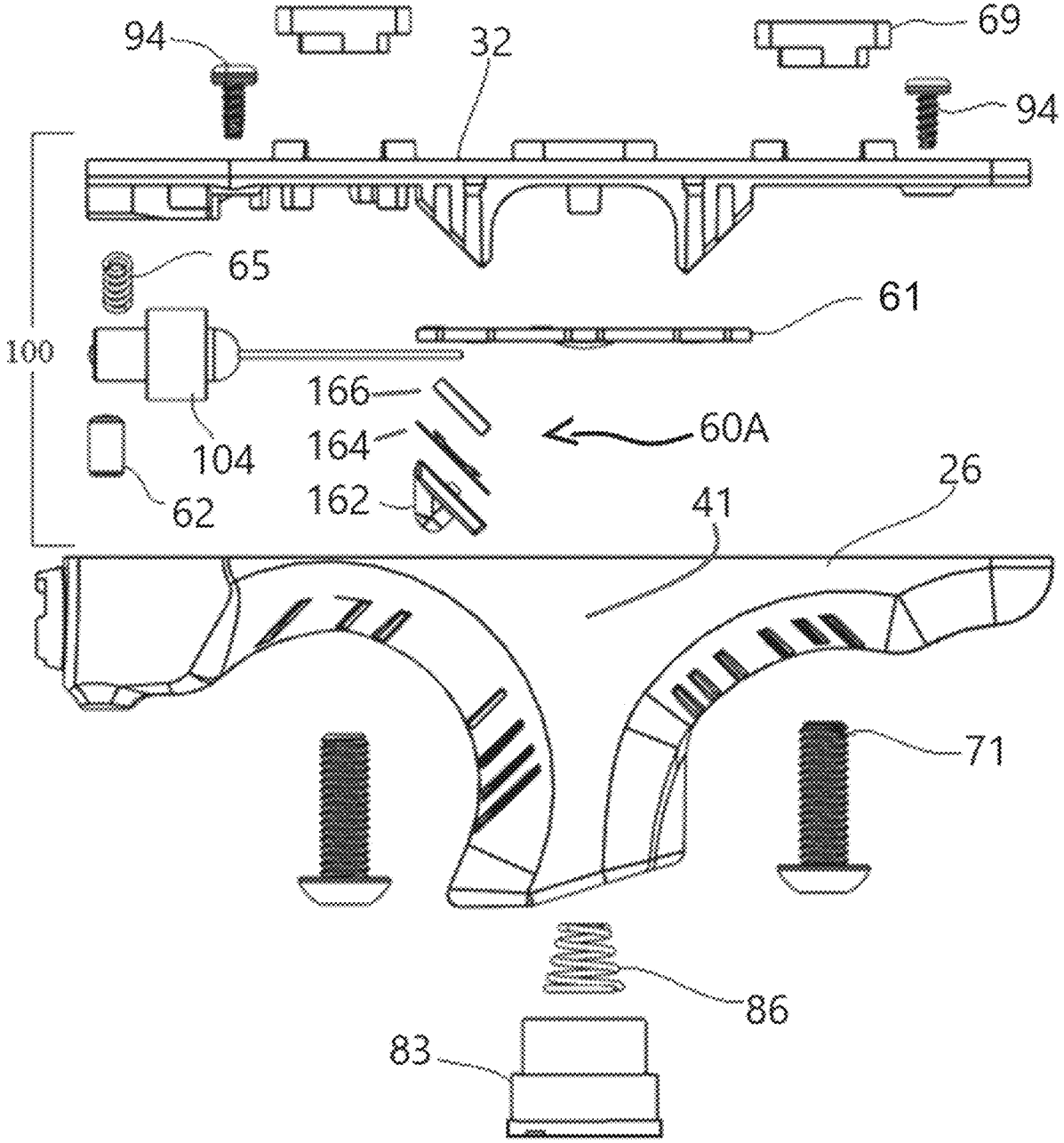
FIG. 4 depicts a left-side exploded view of the device of FIG. 2A, according to one or more embodiments of the disclosure.
Figure 5A:
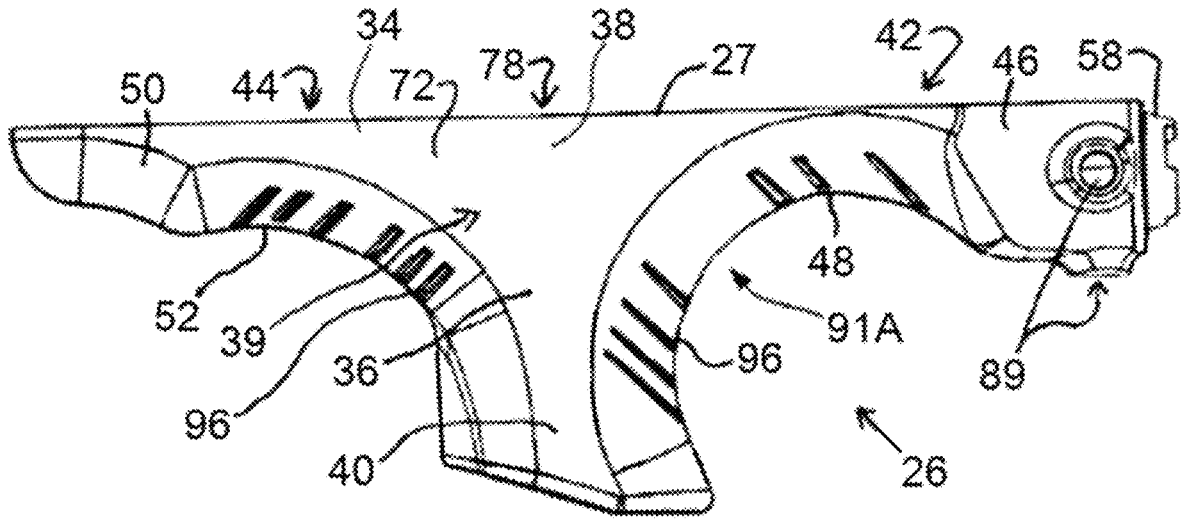
FIG. 5A depicts a right-side elevation view of a body portion of the device of FIG. 2A, according to one or more embodiments of the disclosure.
Figure 5B:
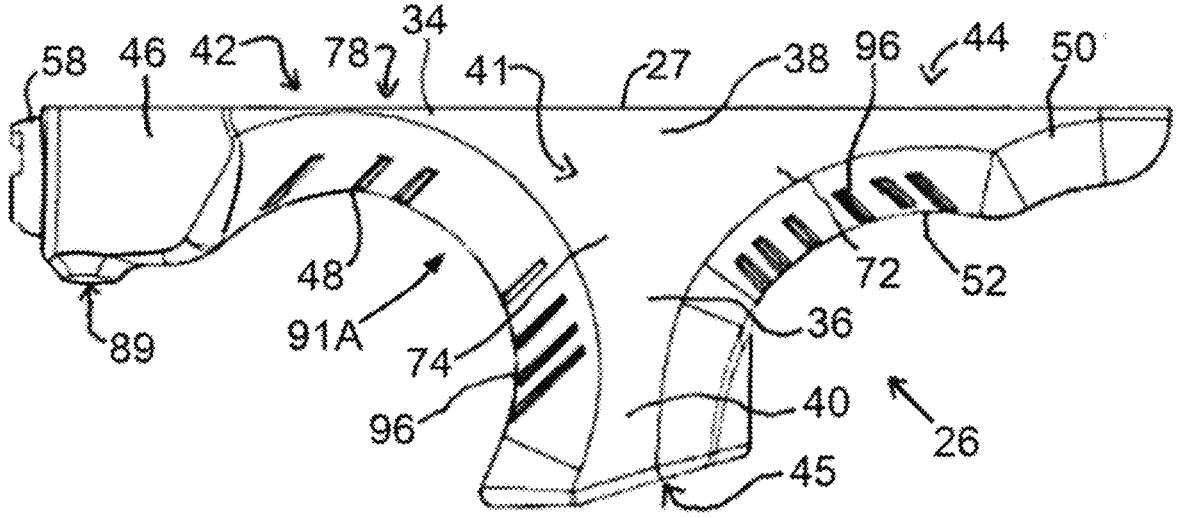
FIG. 5B depicts a left-side elevation view of the body portion of FIG. 5A, according to one or more embodiments of the disclosure.
Figure 5C:
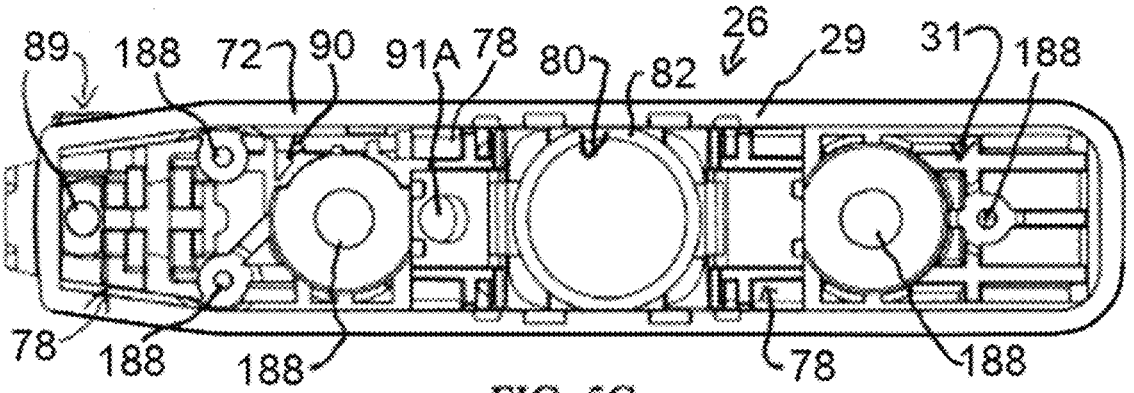
FIG. 5C depicts a top plan view of the body portion of FIG. 5A, according to one or more embodiments of the disclosure.
Figure 5D:
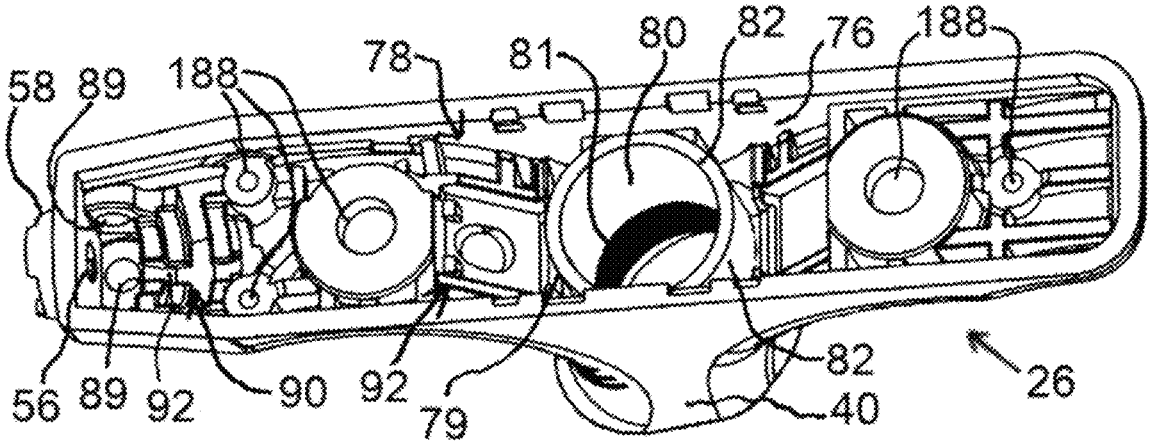
FIG. 5D depicts a left-side top perspective view of the body portion of FIG. 5A, according to one or more embodiments of the disclosure.
Figure 5E:
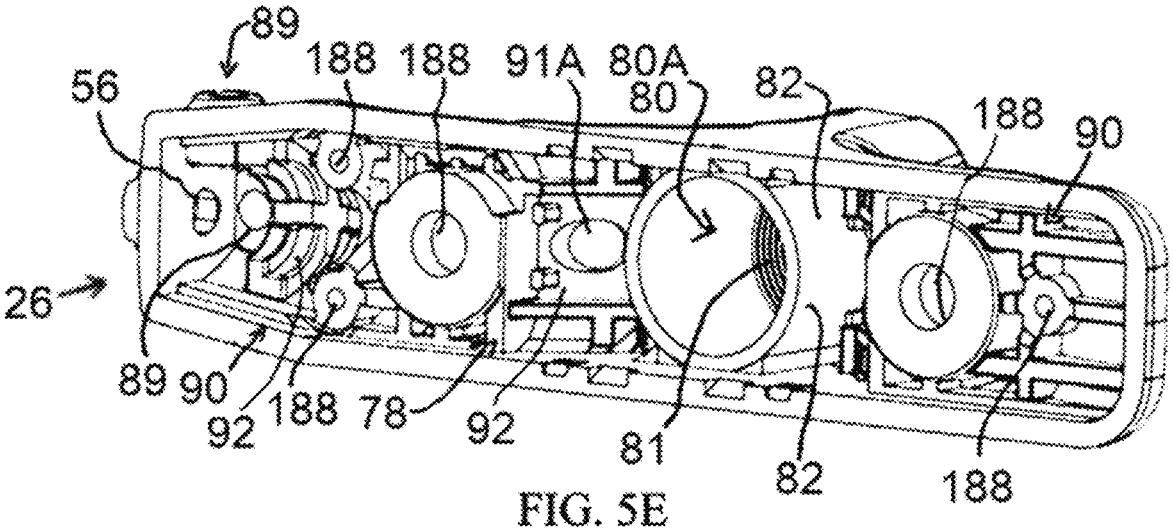
FIG. 5E depicts a top rear perspective view of the body portion of FIG. 5A, according to one or more embodiments of the disclosure.
Figure 5F:
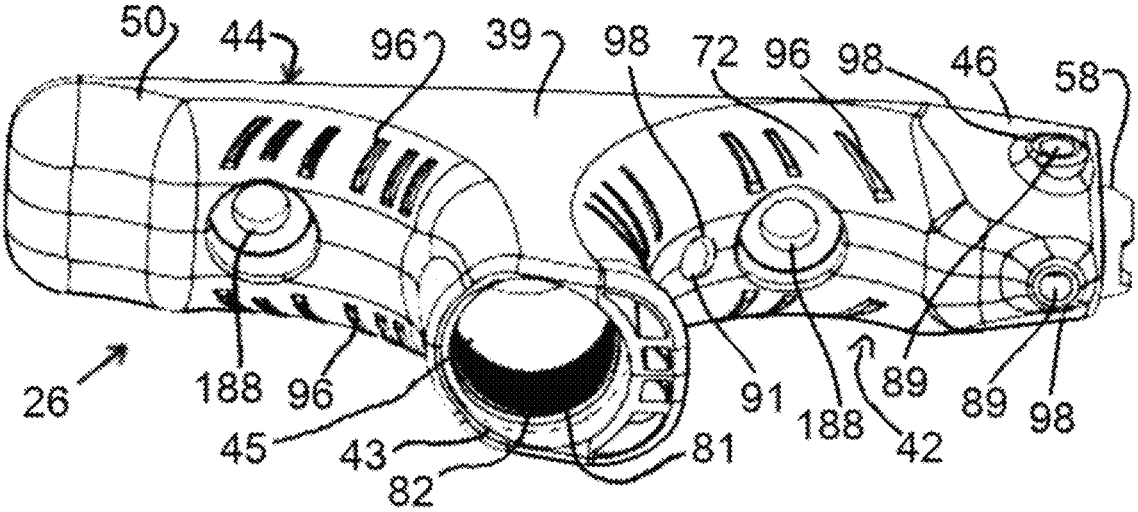
FIG. 5F depicts a right-side bottom perspective view of the body portion of FIG. 5A, according to one or more embodiments of the disclosure.

FIGS. 3-4, a cross-sectional view along bisecting plane A-A of FIG. 2H and an exploded view of device 12, respectively, illustrate the assembly and positioning of various components of device 12 in one or more embodiments.

FIGS. 5A-5F show a body portion 26 in accordance with one or more embodiments of the disclosure. In embodiments, body portion 26 may include a wall 72 having an outer surface 74 and an inner surface 76 and defining an upward facing receptacle portion 78 bounded by the upper rim 29 and exposed through upper opening 31. In one or more embodiments, wall 72, at lower body portion 40, further defines a lower chamber/compartment 80 bounded by the lower rim 43 and exposed through lower opening 45. In one or more embodiments, receptacle portion 78 extends in upper body portion 34 from rearward portion 44 to forward portion 42 and, when cover portion 32 is coupled to upper portion 34, forms an upper inner chamber/compartment 79. In embodiments, receptacle portion 78 may be exposed or opened to lower chamber/compartment 80.

In one or more embodiments, body portion 26 may comprise inner framework structure 90 extending from inner surface 76 into receptacle portion 78. In embodiments, framework structure 90 may define a plurality of seats 92 for receiving electronic components 102 in assembly of device 12, as illustrated, for example, in FIGS. 3-4.

In embodiments, lower compartment/chamber 80 may be sized and configured to receive a power source and may include a threaded portion 81 for engaging lower cap or cover 83. In one or more embodiments, device 12 may further include an inner sleeve 82 positioned within lower compartment 78, the inner sleeve 82 defines a receptacle/chamber/compartment 80A being sized and configured to receive the power source. In embodiments, inner sleeve 82 may be secured within the lower compartment via an interference fit. In an embodiment, inner sleeve 82 may include an outer retaining ring 85 that mates with an inner retaining ring groove 87 formed in the inner surface 76 of the wall defining the lower compartment 78. In embodiments, inner sleeve 82 may further include an inner threaded portion 81 for engaging lower cap or cover 83.

In embodiments, inner sleeve 82 may be formed of a conductive material, which may be, for example, brass or copper. In embodiments, the inner metal sleeve 82 may be formed of or comprises a brass material. In one or more embodiments, the inner sleeve 82 is an overmolded brass tube, which may be configured for battery contact.

Figure 7:
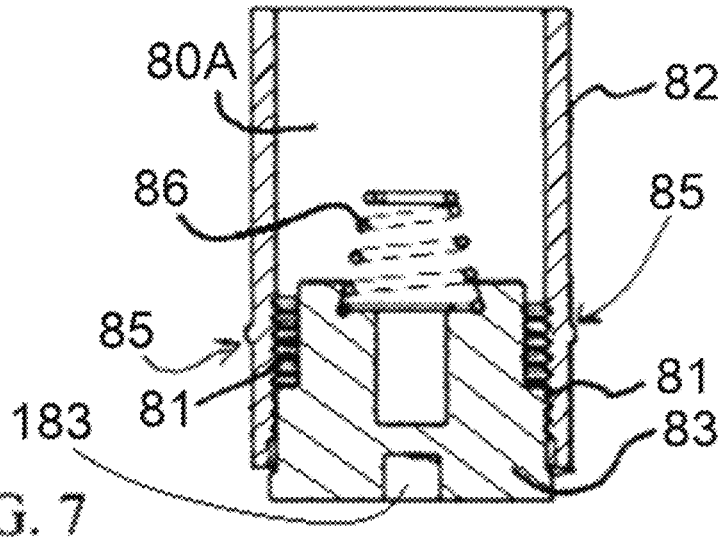
FIG. 7 depicts a cross-sectional side perspective view of a power source assembly of the device of FIG. 2A, according to one or more embodiments of the disclosure.
Figure 8:
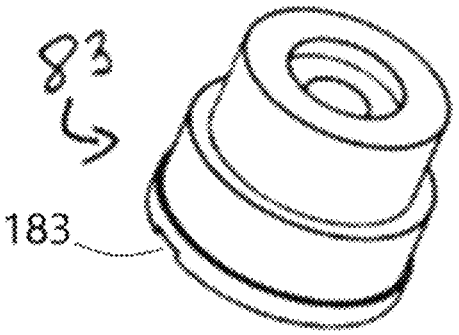
FIG. 8 depicts a side top perspective view of a lower cap of the device of FIG. 2A, according to one or more embodiments of the disclosure.

In one or more embodiments, a power source may be inserted and positioned in the lower compartment 80, within inner sleeve 82. The power source 84 may be covered and secured within the lower compartment by lower cap 83. In embodiments, device 12 may further include a biasing element 86 positioned between the power source 84 and the lower cap 83, as illustrated in FIGS. 3-4 and 7. In an embodiment, as an example, biasing element 86 may be a metal spring. In embodiments, the lower cap 83 may be slotted 183 to facilitate insertion, tightening and removal of lower cap 83, as illustrated in FIGS. 7-8.

In one or more embodiments, the power source 84, such as a battery, is electrically connected by terminals in the power source compartment to laser driving circuitry. The laser driving circuitry is also electrically connected to illumination device 104, which may be a laser diode, and flexible circuitry. In one or more embodiments, device 12 includes inner sleeve 82, wherein the inner sleeve 82 is a metal housing inserted into the lower compartment 80. The metal housing 82 is sized and configured to receive power source 84, for example, a battery. In one or more embodiments, metal housing 82 comprises at least a portion of an electrical path between the inserted power source 84 and one or more electronic components 102. In embodiments, the metal housing 120 may be a brass tube and overmolded in the formation of body portion 26. In one or more embodiments, the power source 84 includes a build-in rechargeable battery. In embodiments, the power source may be a ⅓N battery or the like.

In one or more embodiments, the forward end portion 46 may include a forward-facing aperture 56 and an outer collar 58 framing aperture 56. In embodiments, aperture 56 provides an outlet for illumination emitted from an illumination device disposed within the body portion 26. In embodiments, aperture 56 may be positioned in a forward-facing wall portion of the forward end portion 46, at or adjacent to the a bisecting plane A-A running through forward and rearward end portions 46, 50, between left and right side body portions 34, 36, providing forward facing access to electronic components housed within body portion 26. In embodiments, forward-facing aperture 56 may be covered by a transparent material. In embodiments, in addition to forward facing aperture 56, body portion 26 may further include one or more apertures or outlets for additional electron components, including, for example, illumination and/or recording devices.

In one or more embodiments, body portion 26 may further include one or more of access positions or portions 88 in wall 72 of body portion 26, providing access to activating and/or adjustment components of device 12. In embodiments, access positions or portions 88 may comprise openings and/or thinned or pressure sensitive portions exposed in the wall 72 of body portion 26. In one or more embodiments, body portion 26 includes a plurality of access portions 88 including one or more activator access openings 91 providing access to one or more activation components 60 for activating one or more electronic components of device 12.

In one or more embodiments, wall 72 of body portion 26 may include a plurality of access portions 88 including a pair of adjustor access openings 89 positioned in forward end portion 46 and perpendicularly oriented relative to one another. In embodiments, access openings 89 may be sized and configured to receive adjustment elements 62 that may be used for adjustment of an illumination component housed within the upper chamber 79. In embodiments, adjustment elements 62 may include, for example, windage and elevation adjustment devices, such as, for example, alignment pins or screws.

In embodiments, the body portion 26 may further include a plurality of openings 188 through wall 72 for receiving therethrough connectors and/or fasteners 71, 94, for example, bolts 71 and screws 94, for coupling upper cover portion 32 to body portion 26 and device 12 to a firearm. As an example, fasteners 94 may be round head threadforming screws, which may be 4.5 mm.

In embodiments, body portion 26 may one integrally molded piece. In embodiments, body portion may comprise a thermoplastic polymer material. In one or more embodiments, the body portion 26 may comprise 30% fiber reinforced nylon.

Figure 6A:
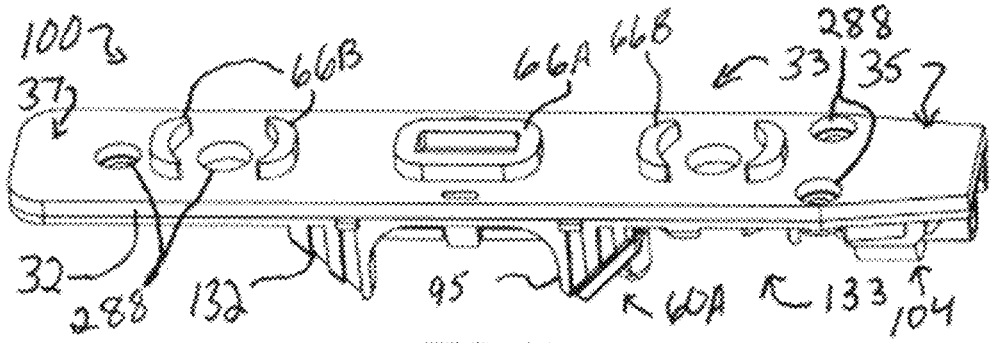
FIG. 6A depicts a right-side top perspective view of an electronic assembly of the device of FIG. 2A, according to one or more embodiments of the disclosure.
Figure 6B:
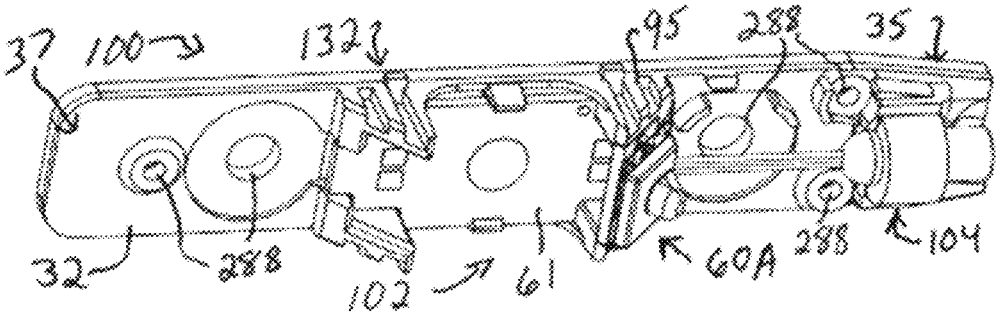
FIG. 6B depicts a right-side bottom perspective view of the electronic assembly of FIG. 6A, according to one or more embodiments of the disclosure.

Referring to FIGS. 6A-6D, device 12 may include an electronics assembly 100 in one or more embodiments of the disclosure. FIGS. 6A-6B are bottom side perspective views showing electronics assembly 100 with the electronic components 102 positioned relative to one another in assembled arrangement, in one or more aspects of the disclosure. Electronics assembly 100 may comprise the cover portion 32 and one or more electronic components 102. In one or more embodiments, cover portion 32 has an upper face portion 33 having mounting interfaces 66, which may include a central mounting interface 66A and mounting fastener interfaces 66B, a lower surface portion 133 and a framework structure 132 formed on and extending from lower surface portion 133. When coupled to upper portion 34 of body portion 26 in assembly of device 12, cover portion 32 partially defines upper inner chamber/compartment 79.

In embodiments, cover portion 32 may further include a plurality of openings 288 through upper cover portion 32 corresponding with those in wall 72 of body portion 26 receiving therethrough connectors and/or fasteners, for example, screws 94 and bolts 71, for coupling upper cover portion 32 to body portion 26 and device 12 to a firearm.

Figure 6C:
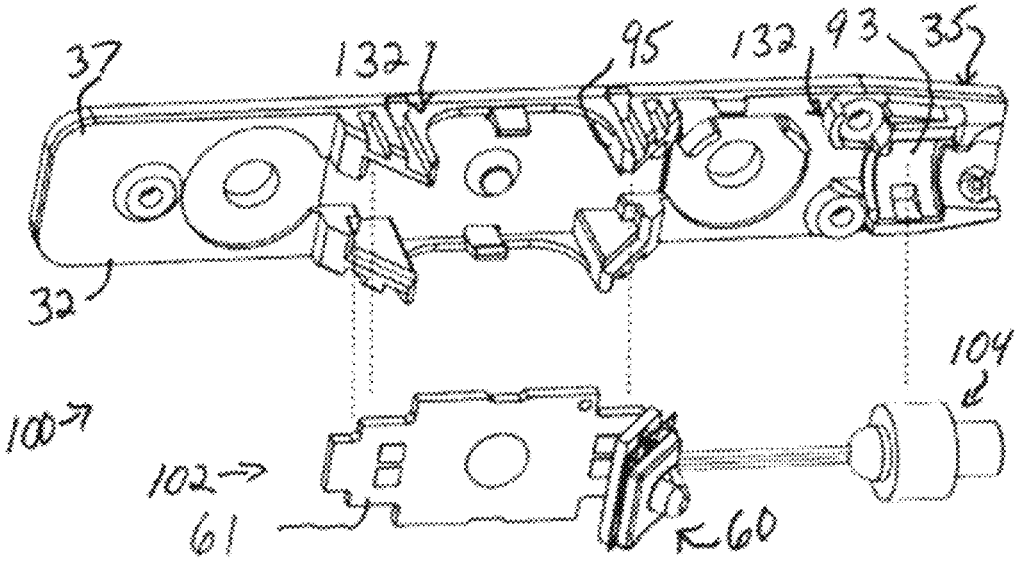
FIG. 6C depicts a right-side bottom perspective exploded view of the electronic assembly of FIG. 6A, according to one or more embodiments of the disclosure.

In one or more embodiments, framework structure 132 defines a plurality of seats or recesses 93 and/or mounts 95 for receiving the electronic components 102 of the electronics assembly 100. In one or more embodiments, as illustrated in FIGS. 6A-6B, electronic components 102 may be seated and/or mounted on the framework structure 132 of upper cover 32 and positioned to correspond to the framework structure 90 of the body portion 26. FIG. 6C depicts a bottom side partial exploded perspective view of the electronics assembly 100 showing electronics assembly 100 with the electronic components 102 drawn apart from lower surface portion 133 and their seated and mounted positions.

Figure 6D:
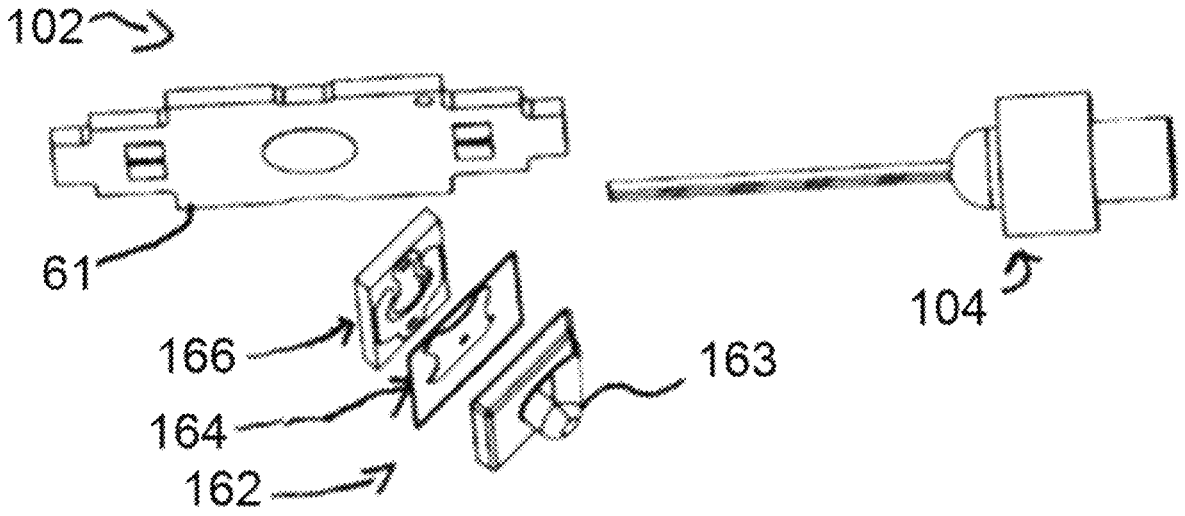
FIG. 6D depicts a right-side bottom perspective exploded view of electronic components of the electronic assembly of FIG. 6A, according to one or more embodiments of the disclosure.

FIG. 6D is a bottom side exploded perspective view of the electronic components 102. In one or more embodiments, electronic components 102 may comprise an illumination component or light source 104, one or more activation components 60 for activating the illumination component 104 and a conductor component, which may be a printed circuit board (PCB) 61 in electrical communication with the power source and providing power to the illumination component 104 and one or more activation components 60.

In one or more embodiments, the one or more activation components 60 are operably connected with and used for activating one or more electronic components of device 12, for example, an illumination device 104, such as a laser module. In embodiments, activation element/component(s) 60 (forward activation component 60A shown in FIGS. 6A-6D)) may include and actuator or activator button 162, which may comprise a protrusion portion 163, with a contact 164, which may be a momentary switch contact, and a circuit 166, which may be a printed circuit board (PCB), as illustrated in FIGS. 6C-6D. In embodiments, activation element/component 60 may comprise an actuator in any suitable form, including buttons, switches and triggers.

In one or more embodiments, activation component(s) 60 comprises a nylon button 162 with a momentary switch contact 164 on a printed circuit board (PCB) 166. The contact 164 and circuit 166 electrically and operably connects the activator 162 with the one or more electronic devices, such as, for example the illumination device 104.

In an embodiment, activation component 60 comprises a momentary on-off button operably connected to the illumination device 104 via a conductor 61. In embodiments, the protrusion portion 163 of the momentary on-off button may comprise a flexible rubber actuator exposed through an activator opening 91, where it can be closed by the application of slight upward pressure by the user's finger. The momentary on/off button may be a mechanical pressure button, a heat sensitive button, an electrical contact button, or any other suitable button. In alternative embodiments, the button may be of any other operation configuration, including click-on/click-off and such. In embodiments, the button may be operably connected to the illumination device 104 by way of electrically connected contacts and an electrical conductor.

In one or more embodiments, contact 164 is a momentary switch contact in the form of a dome contact snap. An example of a suitable dome contact snap (as illustrated in the Appendix A FIGS.) is a tactile metal dome, when used in conjunction with a printed circuit board, flex circuit, or membrane, become normally-open tactile switches. Tactile metal domes are placed on printed circuit boards by means of pressure-sensitive adhesive tape or they are captured in a pocket design. In their relaxed state, the tactile metal domes rest on the outer rim of the primary pathway. When pushed, the domes collapse and make contact with the secondary pathway, thereby closing the circuit. Switch contacts of different shapes and actuation forces may be used and may be mounted to a variety of switching surfaces, including single or double-sided printed circuit boards, flex circuits, and membrane switch panels, in accordance to specific applications. The switch contacts can be used for electrical contact, tactile-element only, or both electrical and tactile. Such switch contacts may be obtained from Snaptron located in Windsor, Colorado. The switch contact shown in Appendix A FIGS. is part number F06085 from Snaptron.

In embodiments, activator access openings 91 (91A and 91B) are formed in body portion 26 to receive and closely conform to the protrusion portions 163 of activators 162. In one or more embodiments, protrusion portion 163, which may comprise a flexible rubber actuator, is exposed through a forward-facing activator opening 91A, where it can be closed by the application of slight upward pressure by the user's finger.

In one or more embodiments, when cover portion 32 is coupled to body portion 26 and device 12 is assembled, activation component 60A may be positioned adjacent to and may protrude through activator access opening 91A at an access position. In an embodiment, opening 91A may be forwardly oriented at an acute angle and positioned on or adjacent bisecting plane A-A and in one of or between the trunk portion 36 and the forward tapered portion 48.

In one or more embodiments, access opening 91A is positioned such that a line through opening 91A and perpendicular with the outer surface of body surface 26 is at an angle in the range of 39.05 degrees to 48.30 degrees relative to the longitudinal axis 5 of device 12. In an embodiment, access opening 91A is positioned at an angle in the range of 41.35 degrees to 46.00 degrees relative to axis 5. In further embodiments, access opening 91A is positioned at an angle of about 43.68 degrees relative to axis 5. In one or more embodiments, an activation component 60B may alternatively or additionally be positioned adjacent to and may protrude through an activator access opening 91B at an access position rearwardly oriented and positioned on or adjacent bisecting plane A-A and in one of or between the trunk portion 36 and the rearward tapered portion 52.

As illustrated in FIGS. 9A-11, device 12 may further comprise a second activation component 60B, as described above, such that the device 12 comprises a forward activation component 60A and a rearward activation component 60B, each having an activator 162 exposed through an access opening (91A and 91B, respectively). In one or more embodiments, forward activation component 60A and a rearward activation component 60B may each comprise a momentary on-off button operably connected to the illumination device 104 via a conductor. In embodiments, the momentary on-off buttons may each have a flexible rubber actuator exposed through an access opening 91, where they can be closed by the application of slight upward pressure by the user's finger or hand. The forward and rearward activation components 60A, 60B, may activate the illumination device together or independently. As described above, the momentary on/off buttons may be a mechanical pressure button, a heat sensitive button, an electrical contact button, or any other suitable button. In alternative embodiments, the button may be of any other operation configuration, including click-on/click-off and such. In embodiments, the button may be operably connected to the illumination device 104 by way of electrically connected contacts and an electrical conductor.

In one or more embodiments, when cover portion 32 is coupled to body portion 26 and device 12 is assembled, forward and rearward activation components 60A, 60B may be positioned adjacent to and may protrude through forward and rearward activator access openings 91A, 91B, respectively. In one or more embodiments, forward activator access opening 91A and activation component 60A are forwardly oriented at an acute angle and positioned on or adjacent bisecting plane A-A and in one of or between the trunk portion 36 and the forward tapered portion 48. Alternatively, or additionally, rearward activator access opening 91B and activation component 60B are rearwardly oriented at an acute angle and positioned on or adjacent bisecting plane A-A and in one of or between the trunk portion 36 and the rearward tapered portion 52.

In one or more embodiments, access opening 91B is positioned such that a line through opening 91B and perpendicular with the outer surface of body surface 26 is at an angle in the range of 29.00 degrees to 39.00 degrees relative to the longitudinal axis 5 of device 12. In an embodiment, access opening 91A is positioned at an angle in the range of 31.50 degrees to 36.50 degrees relative to axis 5. In further embodiments, access opening 91A is positioned at an angle of about 34.00 degrees relative to axis 5.

Figure 9A:
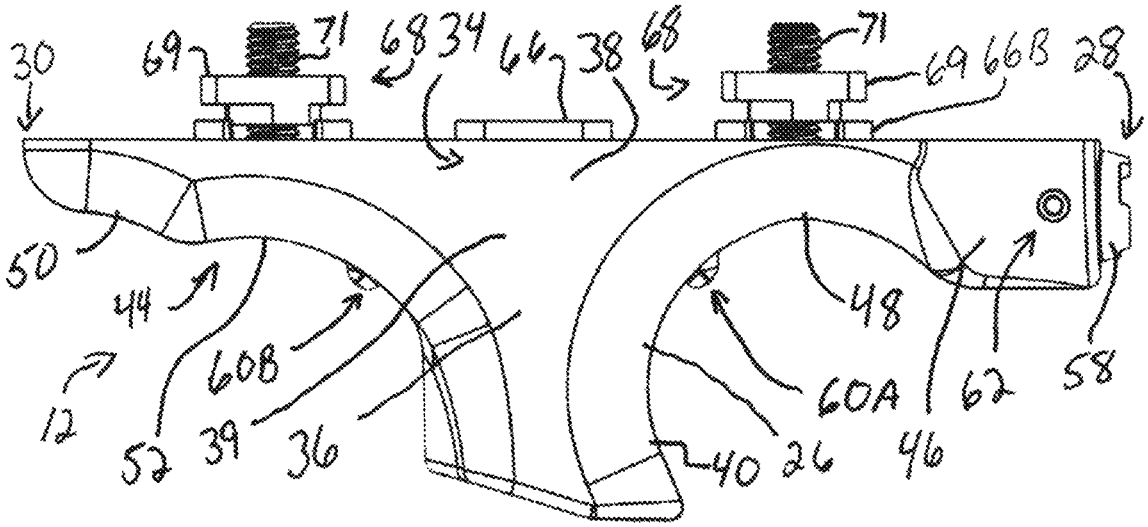
FIG. 9A depicts a right-side elevation view of an accessory device, according to one or more embodiments of the disclosure.
Figure 9B:
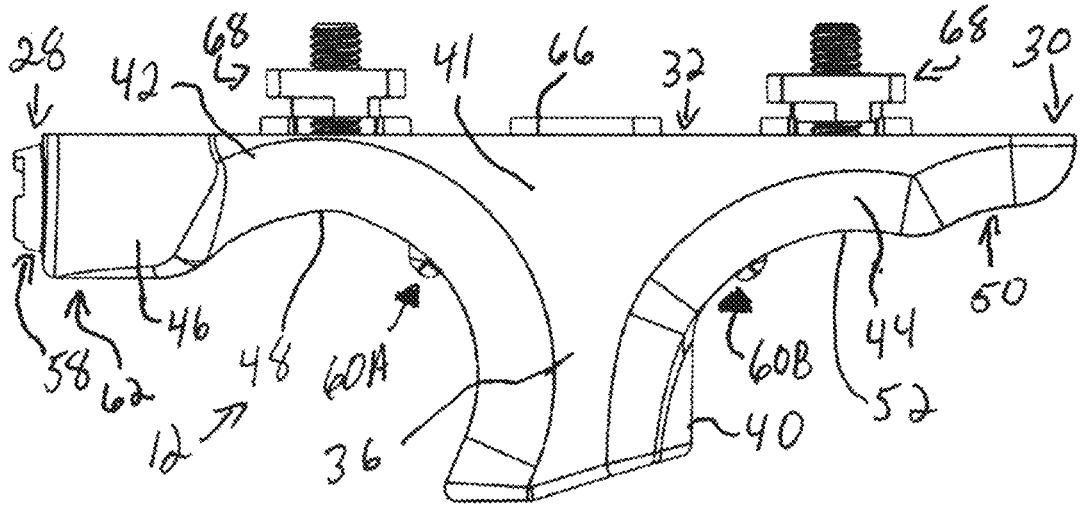
FIG. 9B depicts a left-side elevation view of the device of FIG. 9A, according to one or more embodiments of the disclosure.
Figure 9C:
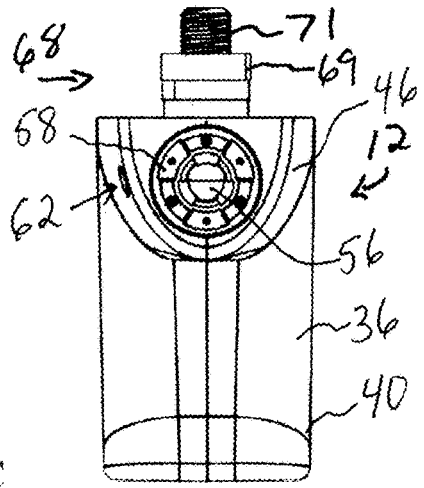
FIG. 9C depicts a front view of the device of FIG. 9A, according to one or more embodiments of the disclosure.
Figure 9D:
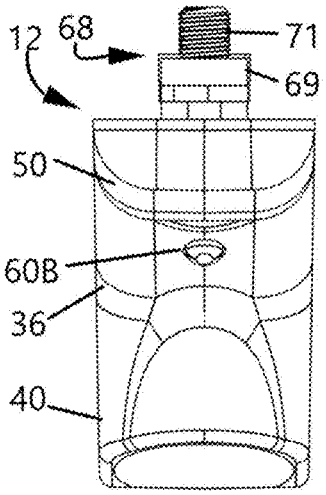
FIG. 9D depicts a rear view of the device of FIG. 9A, according to one or more embodiments of the disclosure.
Figure 9E:
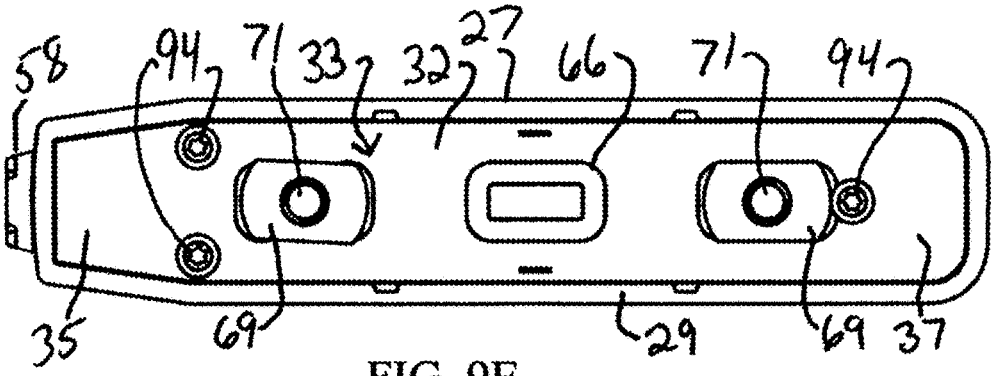
FIG. 9E depicts a top plan view of the device of FIG. 9A, according to one or more embodiments of the disclosure.
Figure 9F:
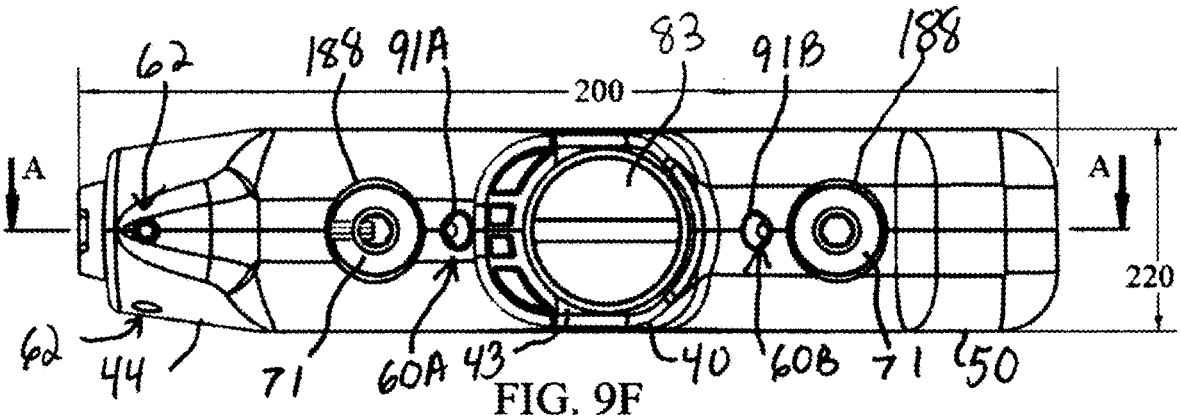
FIG. 9F depicts a bottom plan view of the device of FIG. 9A, according to one or more embodiments of the disclosure.
Figure 10:
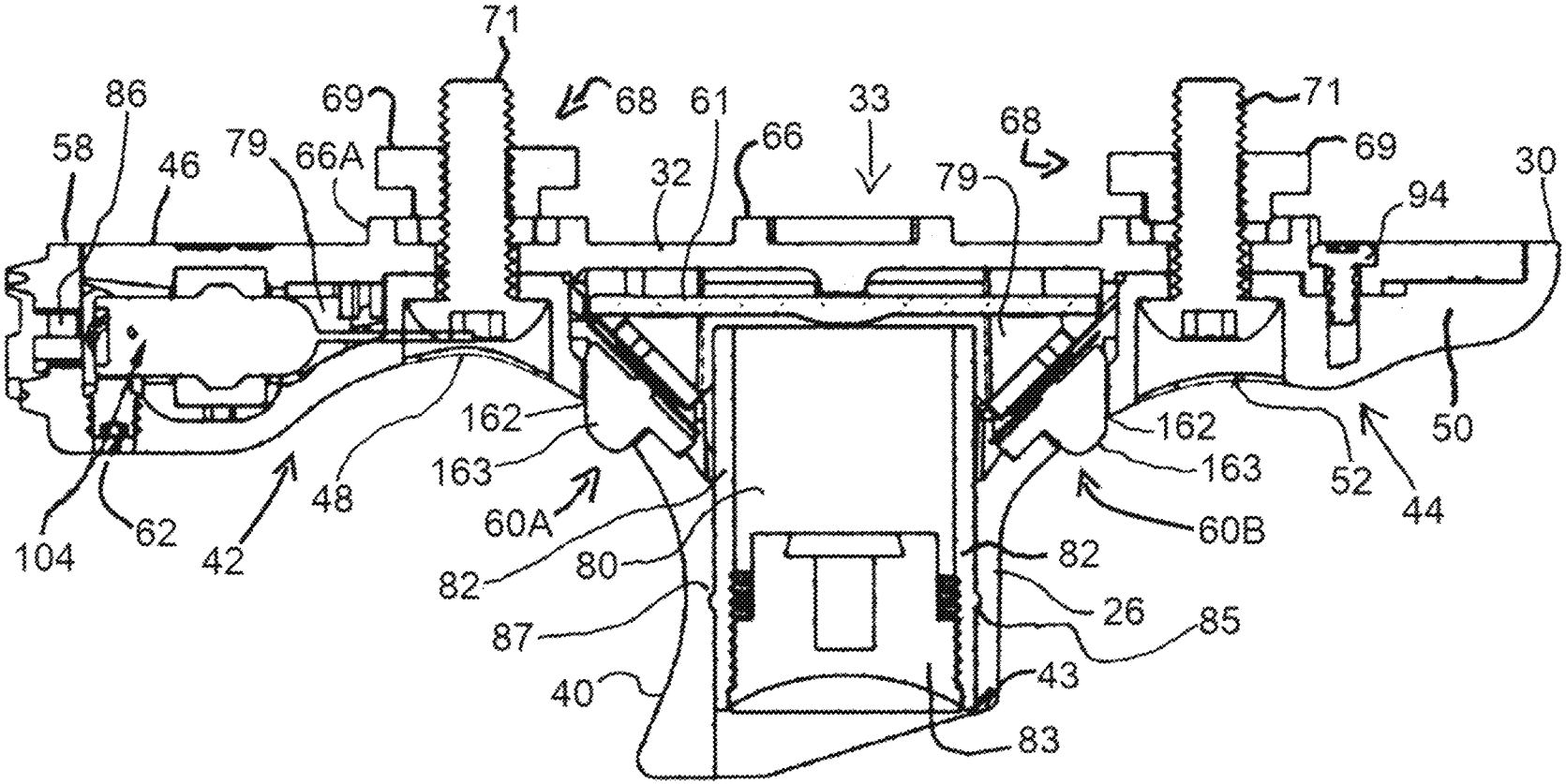
FIG. 10 depicts a cross-sectional view of the device of FIG. 9A at line A-A of FIG. 9F, according to one or more embodiments of the disclosure.
Figure 11:
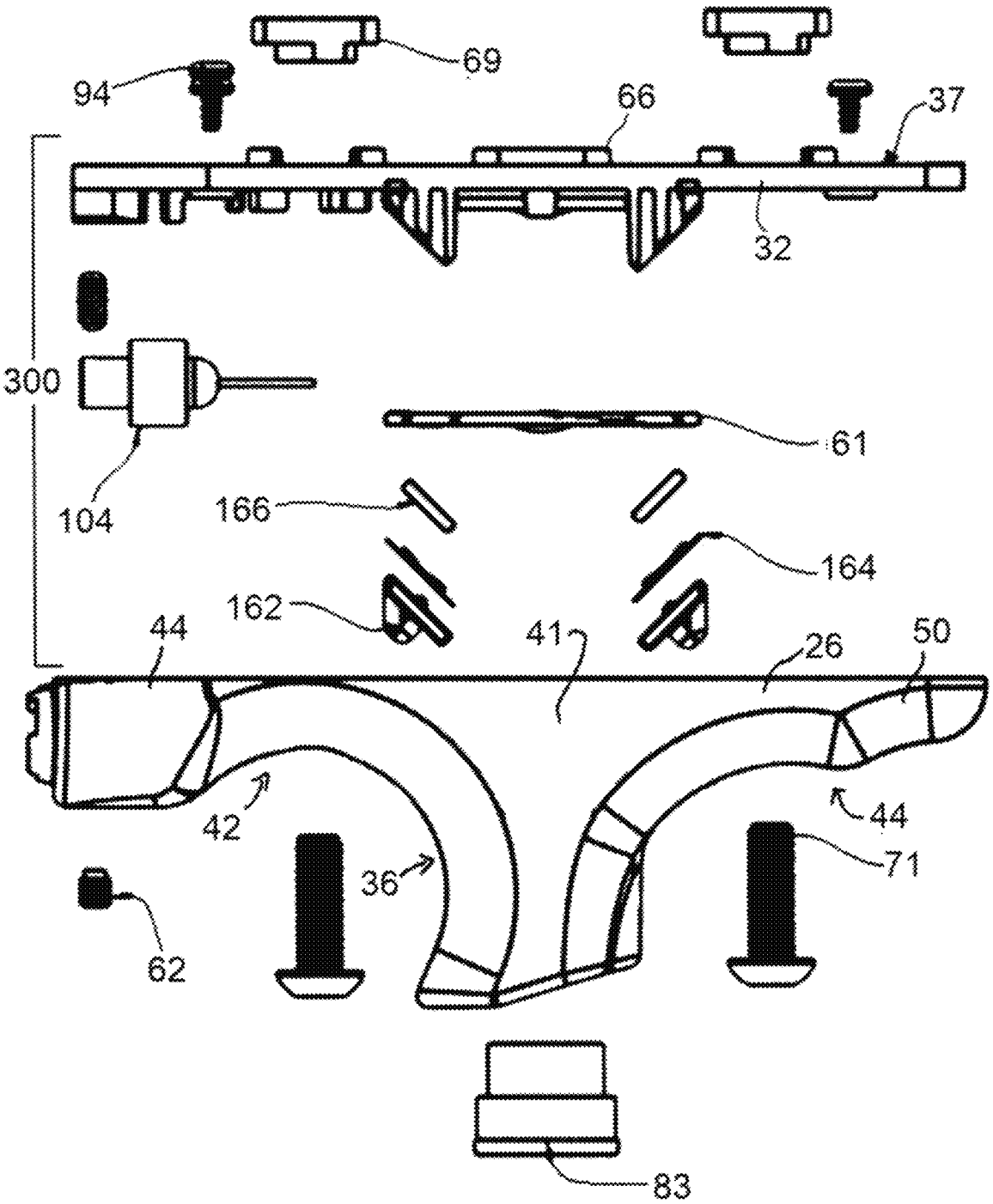
FIG. 11 depicts a left-side exploded view of the device of FIG. 9A, according to one or more embodiments of the disclosure.

FIGS. 10, a cross-sectional view along bisecting plane A-A of FIG. 9F, and FIG. 11, an exploded view of device 12, illustrate the assembly and positioning of various components of device 12, in one or more alternative embodiments further having a rearward activation component 60B.

Figure 12A:
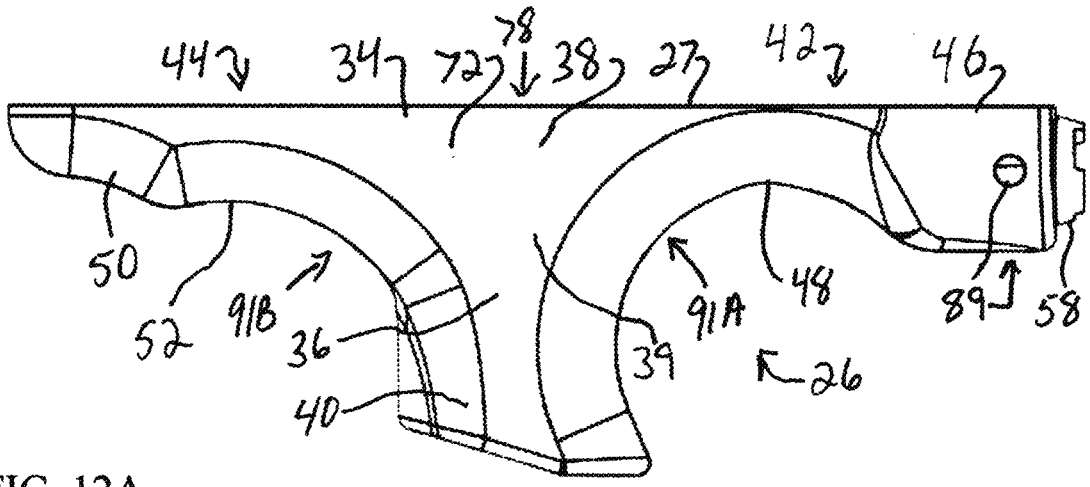
FIG. 12A depicts a right-side elevation view of a body portion of the device of FIG. 9A, according to one or more embodiments of the disclosure.
Figure 12B:
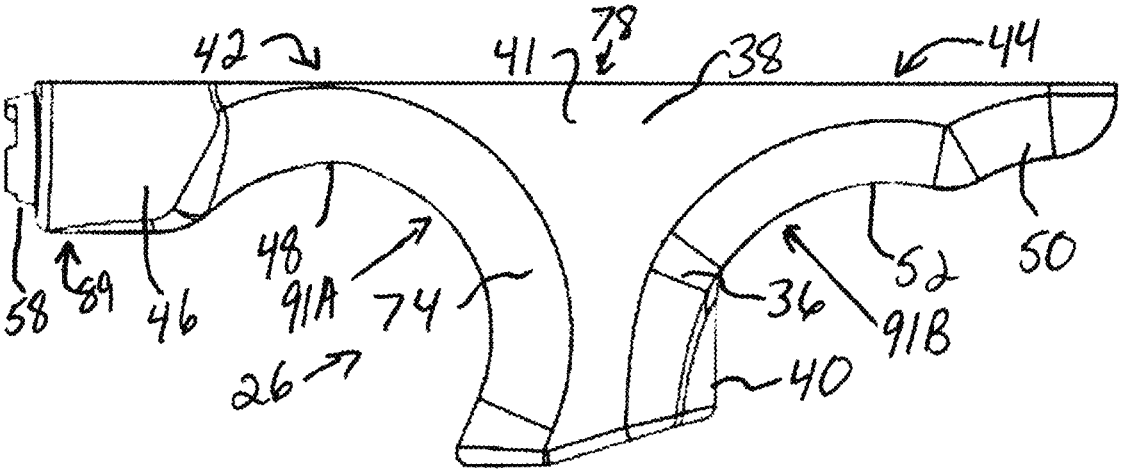
FIG. 12B depicts a left-side elevation view of the body portion of FIG. 12A, according to one or more embodiments of the disclosure.
Figure 12C:
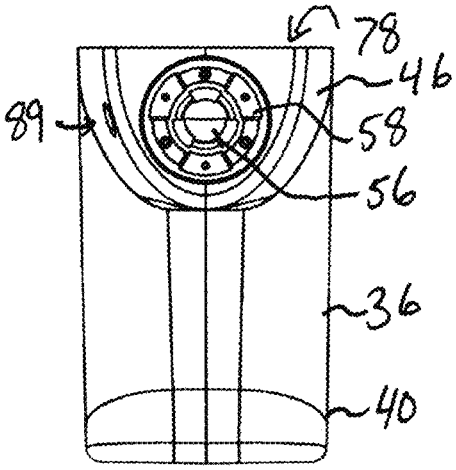
FIG. 12C depicts a front view of the body portion of FIG. 12A, according to one or more embodiments of the disclosure.
Figure 12D:
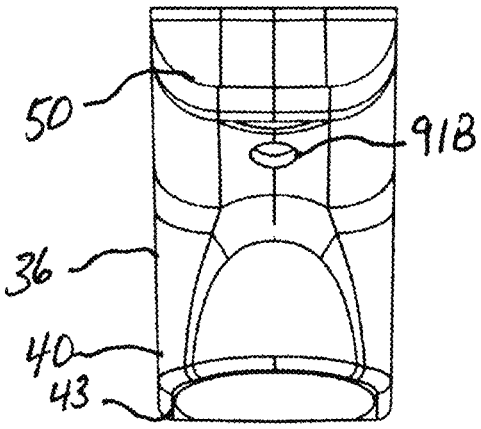
FIG. 12D depicts a rear view of the body portion of FIG. 12A, according to one or more embodiments of the disclosure.
Figure 12H:
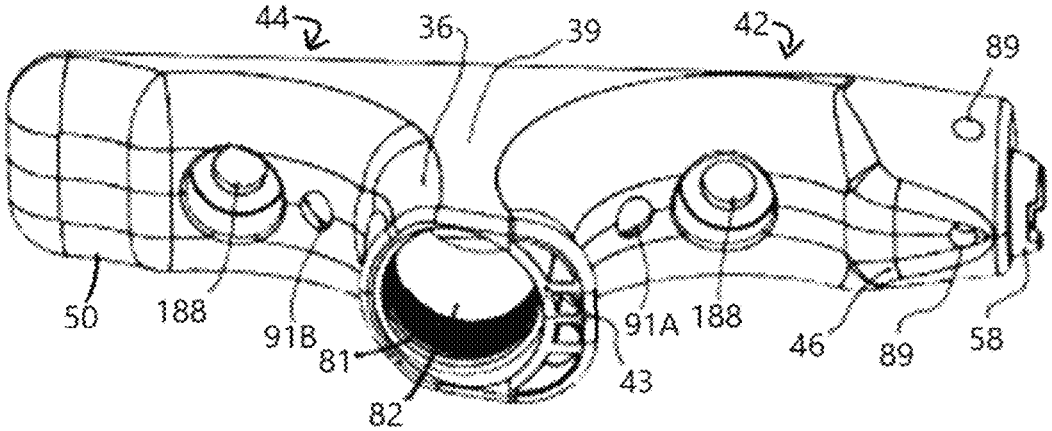
FIG. 12H depicts a right-side bottom perspective view of the body portion of FIG. 12A, according to one or more embodiments of the disclosure.

FIGS. 12A-12H illustrate the body portion 26 of device 12, in one or more alternative embodiments further having a rearward activation component 60B. As illustrated in FIG. 12E-12G2, in accordance with one or more embodiments, body portion 26 may further include a rearward activator access opening 91B and framework structure 90 of body portion 26 may further defines seats 92 for receiving electronic components associated with the rearward activation component 60B, opposingly situated relative to those associated with the forward activation component 60A.

Figure 13A:
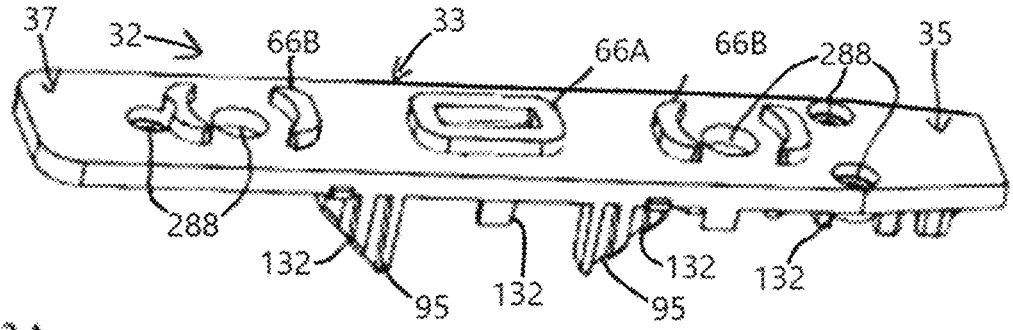
FIG. 13A depicts a right-side top perspective view of a cover portion of the device of FIG. 9A, according to one or more embodiments of the disclosure.
Figure 13B:
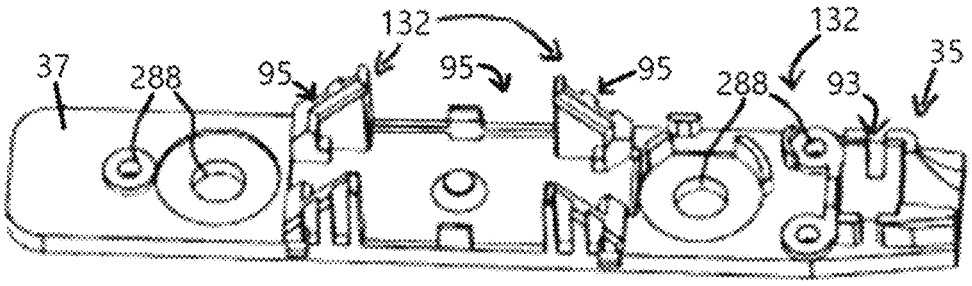
FIG. 13B depicts a left-side bottom perspective view of the cover portion of FIG. 13A, according to one or more embodiments of the disclosure.

FIGS. 13A-13B illustrate the cover portion 32 of device 12, in one or more embodiments further having a rearward activation component 60B. As illustrated further in FIG. 13A-13B, in accordance with one or more embodiments, framework structure 132 of cover portion 32 may further define seats or recesses 93 and/or mounts 95 for receiving the electronic components associated with the forward and rearward activation components 60A and 60B, opposingly situated relative to one another.

Figure 14A:
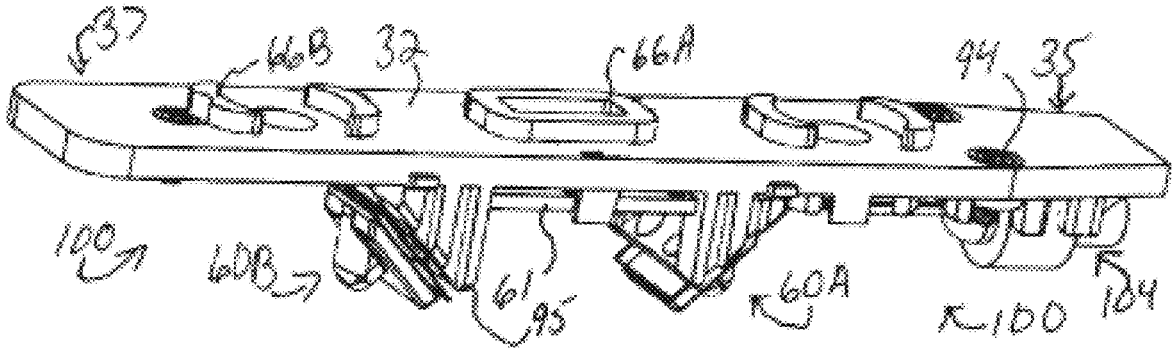
FIG. 14A depicts a right-side top perspective view of an electronic assembly of the device of FIG. 2A with fastener screws, according to one or more embodiments of the disclosure.
Figure 14B:
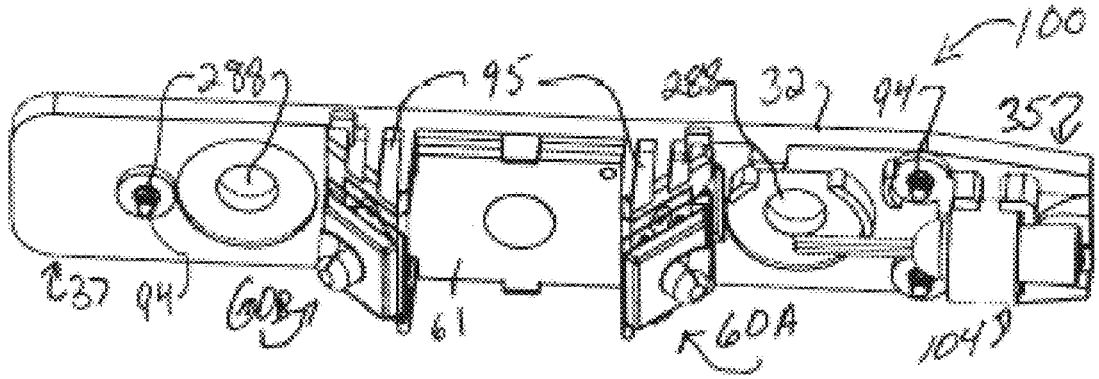
FIG. 14B depicts a right-side bottom perspective view of an electronic assembly of the device of FIG. 2A with fastener screws, according to one or more embodiments of the disclosure.

FIGS. 14A-14B illustrate the electronics assembly 100, in one or more embodiments further having a rearward activation component 60B. FIGS. 14A-14B are bottom and top perspective views, respectively, showing the electronic components 102 associated with the forward and rearward activation components 60A, 60B, positioned relative to one another in assembled arrangement. In the embodiment shown, electronic components 102 of the forward and rearward activation components 60A, 60B, may be seated and/or mounted on the framework structure 132 of upper cover 32 and positioned to correspond to the framework structure 90 of the body portion 26.

Figure 15A:
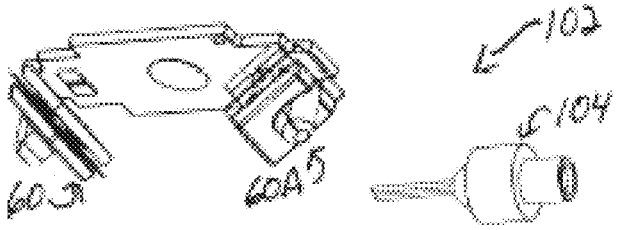
FIG. 15A depicts a bottom side perspective view of electronic components of the electronic assembly of FIGS. 14A-14B, according to one or more embodiments of the disclosure.
Figure 15B:
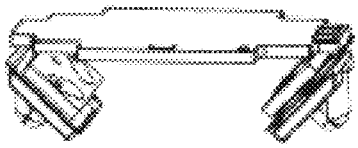
FIG. 15B depicts a top side perspective view of electronic components of the electronic assembly of FIGS. 14A-14B, according to one or more embodiments of the disclosure.
Figure 16:
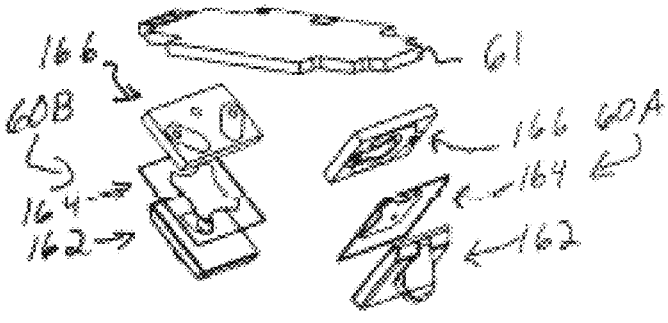
FIG. 16 depicts a top perspective exploded view of electronic components of the electronic assembly of FIGS. 14A-14B, according to one or more embodiments of the disclosure.

FIG. 15A depicts an exploded perspective view of the electronic components 102. In one or more embodiments, electronic components 102 may further comprise an illumination component or light source 104, forward and rearward activation components 60A, 60B, for activating the illumination component 104, together and/or individually, and a conductor component 61 in electrical communication with the power source and providing power to the illumination component 104 and forward and rearward activation components 60A, 60B. FIG. 15B depicts a top perspective view of electronic components, including forward and rearward activation components 60A, 60B. FIG. 16 depicts an exploded perspective view of electronic components, including forward and rearward activation components 60A, 60B.

In one or more embodiments, the power source 84 is in electrical connection with electronic components 102 of the electronics assembly 100. Power source 84 may be positioned within lower compartment 80 and covered and secured within the lower compartment 80 by lower cap 83. In embodiments, lower compartment 80 may include a threaded portion for engaging a corresponding threaded portion of lower cap 83 or cover. The lower cap 83 may be slotted to facilitate insertion, tightening and removal of the cap.

In one or more embodiments, device 12 includes inner sleeve 82, wherein the inner sleeve 82 is a metal housing inserted into the lower compartment 80. The metal housing 82 may be sized and configured to receive a power source 84, for example, a battery. In one or more embodiments, metal housing 82 comprises at least a portion of an electrical path between the inserted power source 84 and one or more electronic components 102. In embodiments, the metal housing 120 may be brass tube. In an embodiment, metal housing may be overmolded in the formation of body portion 26. In one or more embodiments, the power source 84 includes a build-in rechargeable battery. In embodiments, the power source may be one ⅓ N battery or the like.

In one or more embodiments, the illumination source 104 may be a laser device and power source 84 may be a battery received within lower compartment 80. The battery is electrically connected by terminals in the power source compartment to laser driving circuitry. The laser driving circuitry is also electrically connected to a laser diode and flexible circuitry. The momentary on-off button having a flexible rubber actuator is mounted and protrudes through activator access opening 91 below the flexible circuitry and controls the flow of electricity from the battery to the laser diode.

In one or more embodiments, the electronic or light/illumination device 104 is a laser module (laser diode). In operation, the light source is activated by pressing or engaging the forward and/or rearward activator or actuator 162A, 162B. The laser source may be of any suitable type, including green. In one or more embodiments, the laser module is a 5 MW output Powermax. In an embodiment, the laser sight has a low profile<5 mW peak, 532 nm, Class IIIA laser.

In one or more embodiments, forward and/or rearward activator or actuator 162A, 162B are in communication with the power source, battery, the printed circuit board and the laser module. In embodiments, forward and/or rearward activator or actuator 162A, 162B may have one or more positions or activation settings, each altering the functioning of the battery module and the laser module to enable the laser module to function in one or more settings, which may include: (1) continuously off; (2) continuously on; and/or (3) on only when one or both of the activators is pressed. When activated to be on, the laser may pulse to save power, while still providing a laser light beam adequate to sight a target.

In one or more embodiments, forward and/or rearward activator or actuator 162A, 162B are momentary activators that are pressed by a user's finger. In an embodiment, forward and/or rearward activator or actuator 162A, 162B function so that the laser module is activated if either of activators are pressed. Alternatively, the laser module can be activated only when both forward and rearward activators are pressed simultaneously. In an embodiment, one or both of the activators 162A, 162B are slide buttons.

Figure 18A:
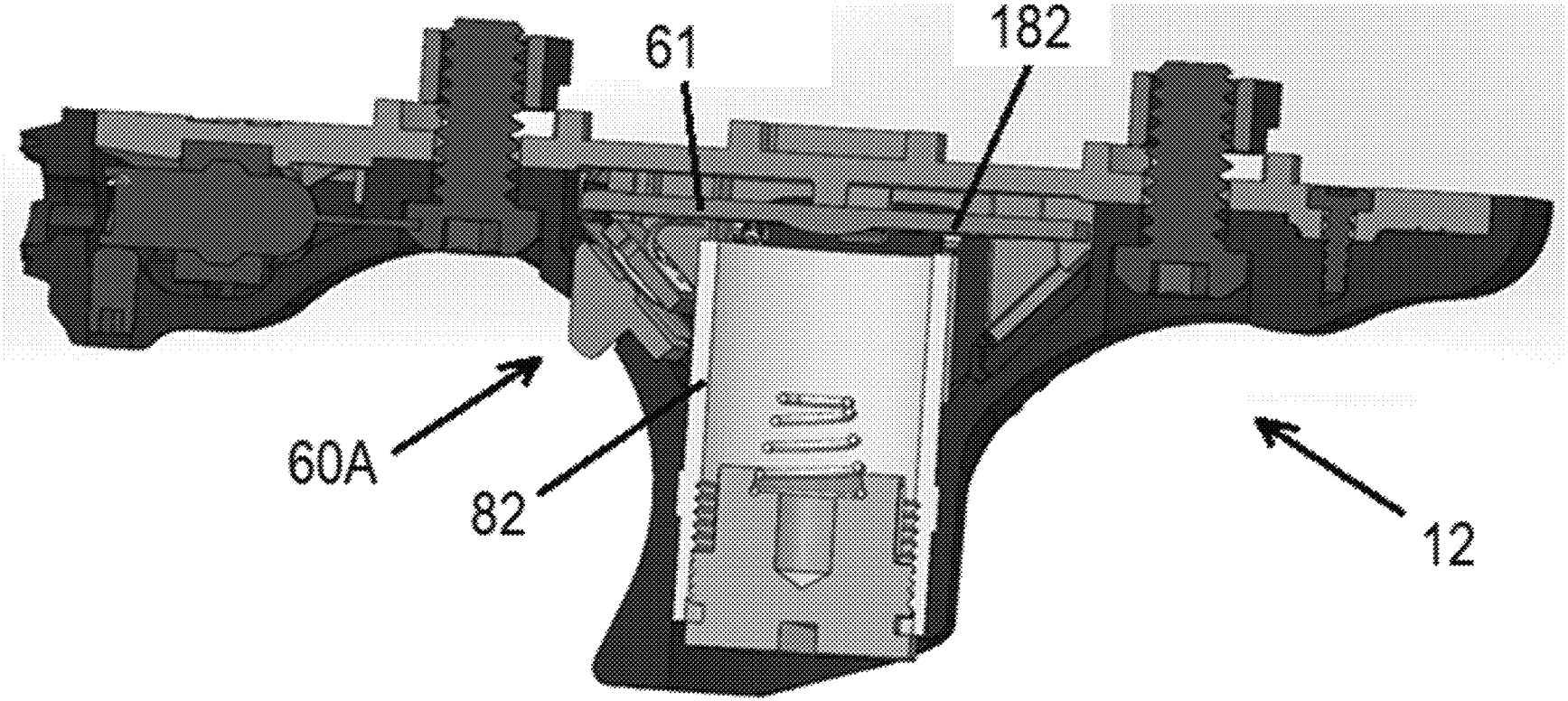
FIG. 18A depicts a cross-sectional view of an accessory device, according to one or more embodiments of the disclosure.
Figure 18B:
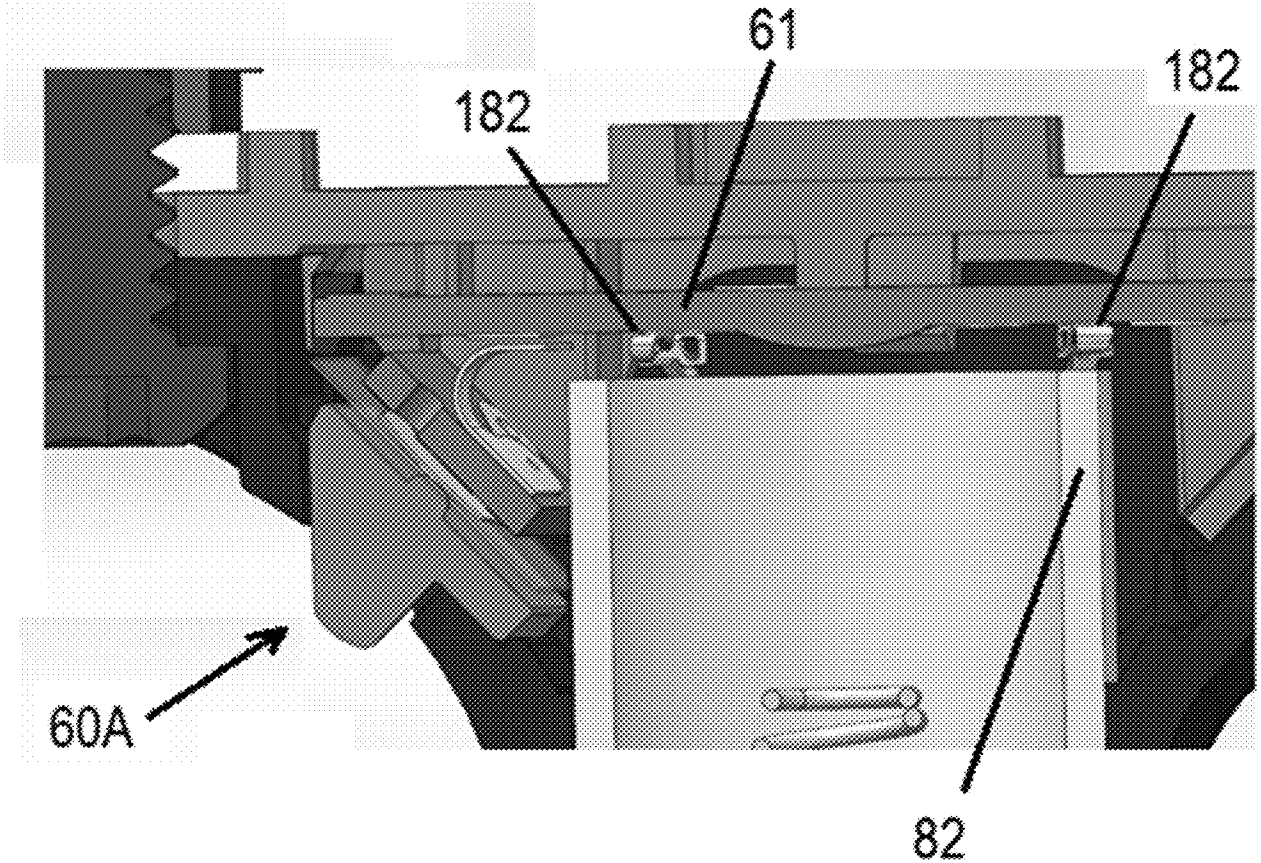
FIG. 18B depicts an exploded view of the device of FIG. 18A, according to one or more embodiments of the disclosure.

Referring to FIGS. 18A-20B, FIG. 18A shows a cross sectional view of an embodiment of the device 12 and FIG. 18B shows a blown up portion of FIG. 18A, illustrating the electrical connecting between the power source, the conductor component/PCB 61 and the forward and rearward activation components 60A, 60B (only forward 60A shown). In one or more embodiments, additional or alternative to the ground wire, the inner sleeve or battery tube 82 (battery negative terminal) may be connected to the PCB 61 ground by spring contacts 182. In embodiments, the device may include 2 spring contacts. In one or more embodiments, the inner sleeve or battery tube 82 (battery negative terminal) may be connected to the PCB 61 ground with a set of 4 radially placed spring contacts 182. The spring contacts 182 may be placed during a surface mount pick and place process that will maintain the ground connection once the device housings are joined or snapped together. When in place, the conductor component/PCB 61 is in electrical communication with the power source and provides power to the illumination component 104 and forward and rearward activation components 60A, 60B.

Figure 19A:
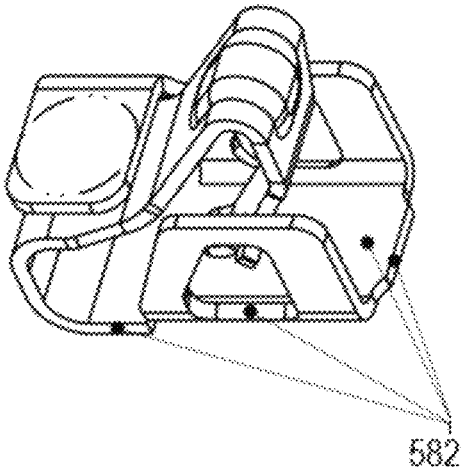
FIG. 19A shows a top side perspective view of a spring contact, according to one or more embodiments of the disclosure.
Figure 19B:
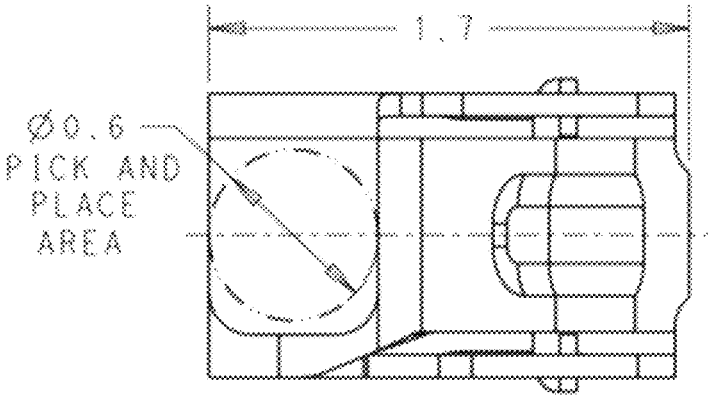
FIG. 19B shows a top plan view of the spring contact of FIG. 19A, according to one or more embodiments of the disclosure.
Figure 19C:
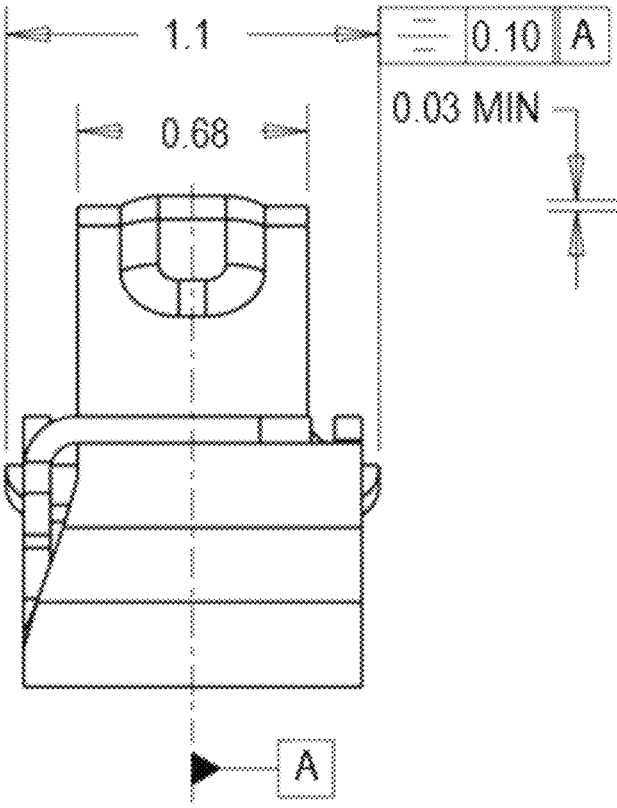
FIG. 19C shows a front view of the spring contact of FIG. 19A, according to one or more embodiments of the disclosure.
Figure 19D:
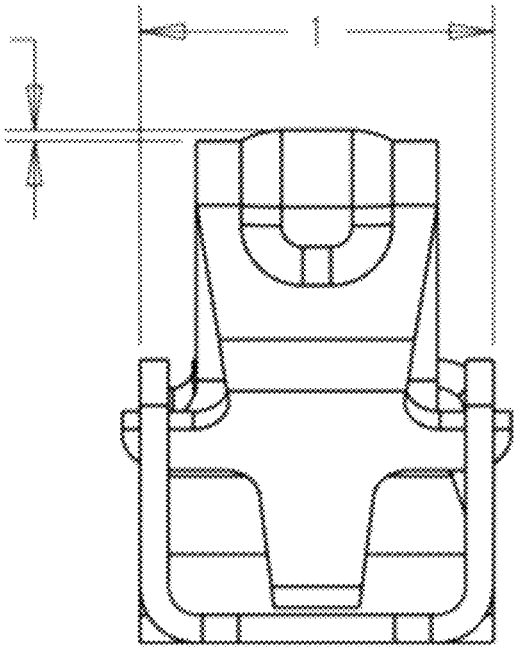
FIG. 19D shows a rear view of the spring contact of FIG. 19A, according to one or more embodiments of the disclosure.
Figure 19E:
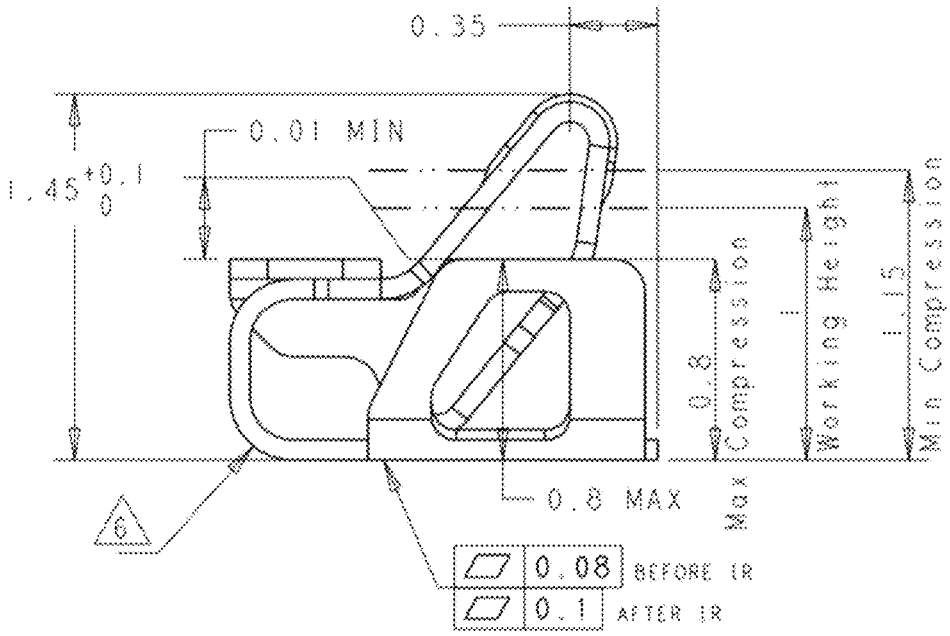
FIG. 19E shows a side view of the spring contact of FIG. 19A, according to one or more embodiments of the disclosure.
Figure 19F:
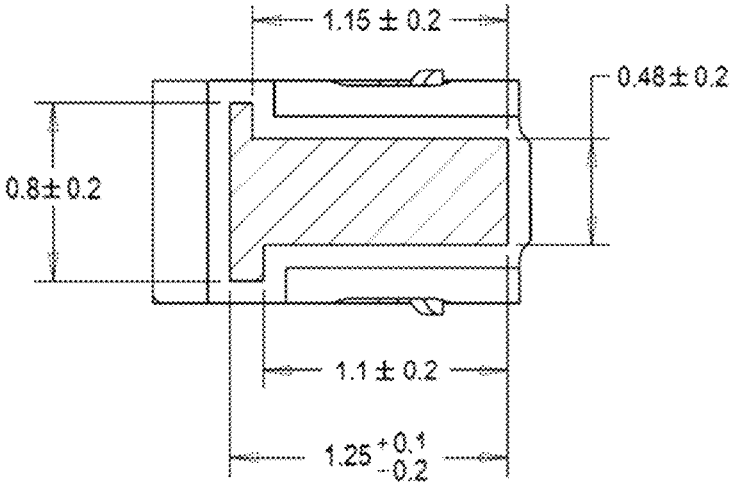
FIGS. 19F-G show cross-section views of the spring contact of FIG. 19A, according to one or more embodiments of the disclosure.
Figure 19G:
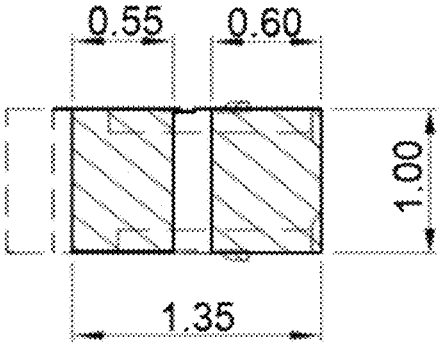
Figure 19H:
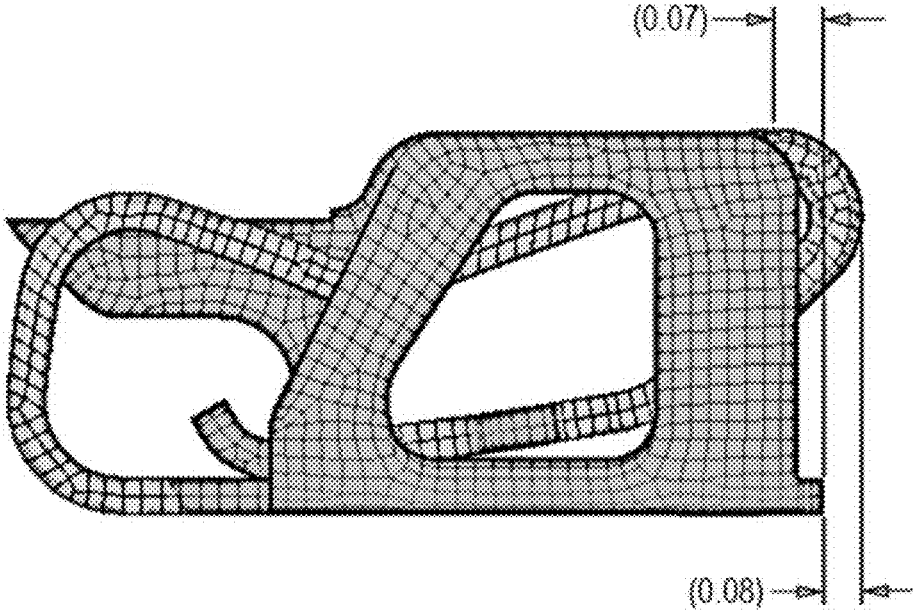
FIG. 19H shows a side view of the spring contact of FIG. 19A in a compressed state, according to one or more embodiments of the disclosure.
Figure 19I:
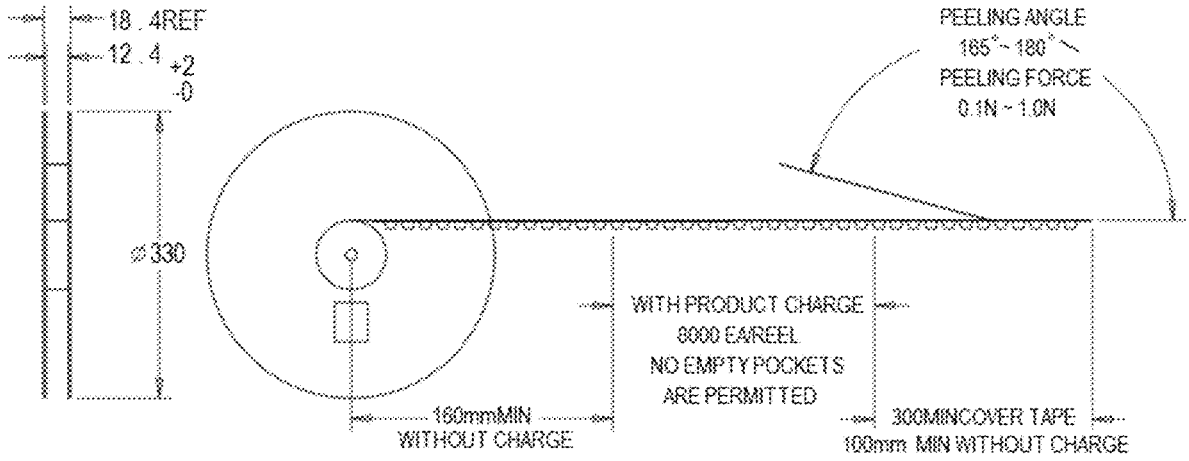
FIGS. 19I-19K show various schematic views and specifications, according to one or more embodiments of the disclosure.
Figure 19J:
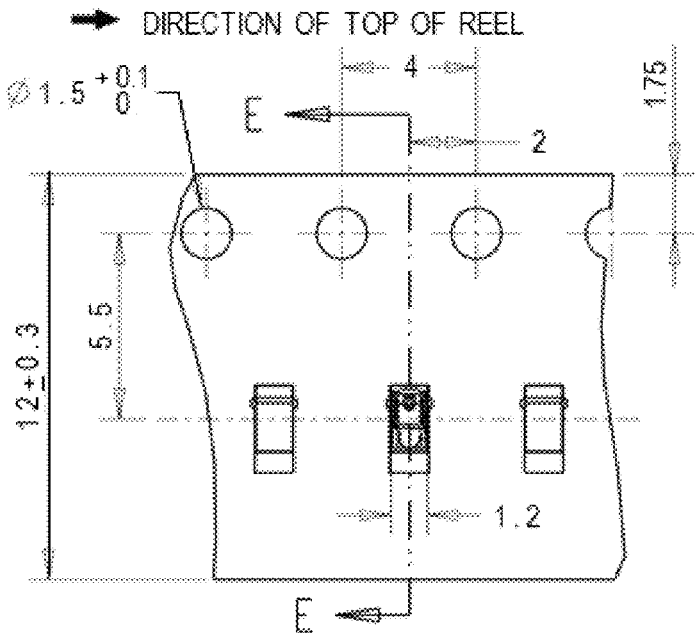
Figure 19K:
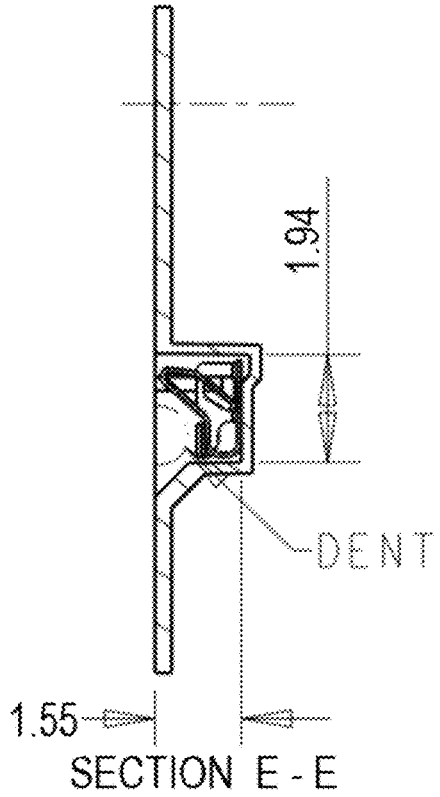

In one or more embodiments, the spring contacts 182 are spring finger contacts. In embodiments, the spring contacts 182 may be TE Connectivity AMP Connectors (Spring Finger 1.45H; part no. 2336713-2), which may be obtained from TTI, Inc. in Fort Worth, Texas. FIGS. 19A-19B illustrate embodiments of the spring contacts 182, showing various schematic views and specifications. In embodiments, the spring contacts are in contact with PCB 61, providing an electrical connection.

Figure 20A:
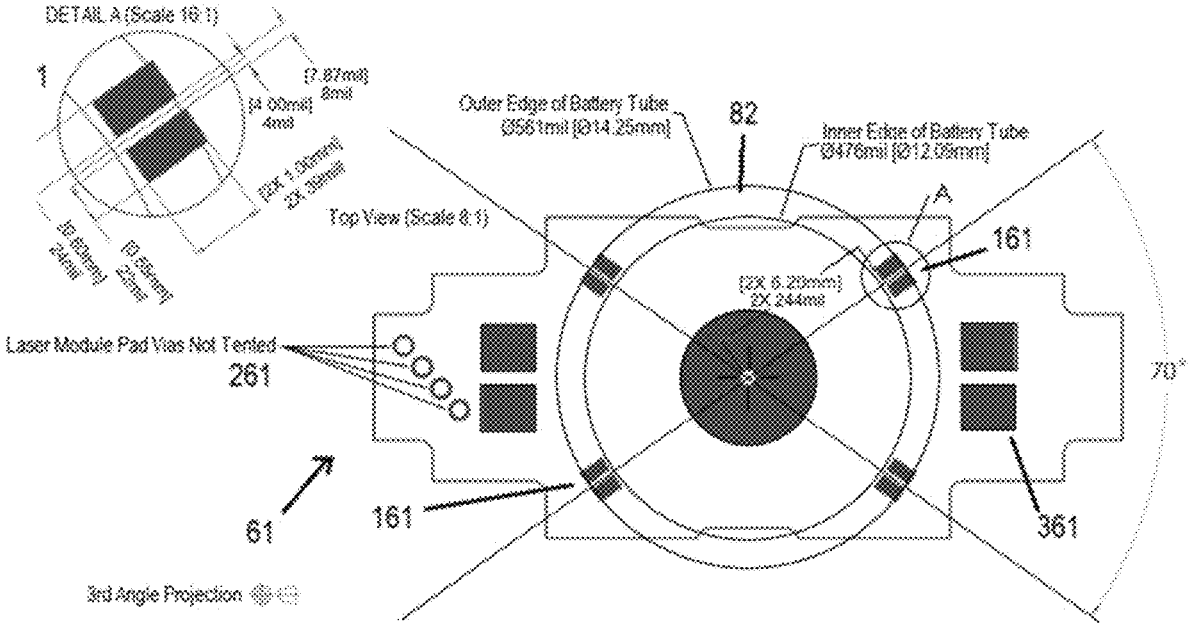
FIG. 20A depicts a top plan view and a partial exploded view of an electronic component of the electronic assembly, according to one or more embodiments of the disclosure.
Figure 20B:
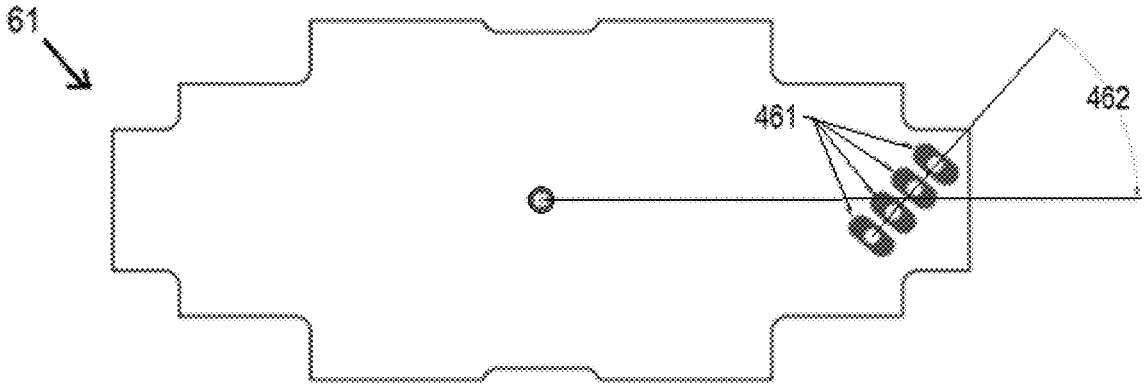
FIG. 20B depicts a bottom plan view of the electronic component of FIG. 20A, according to one or more embodiments of the disclosure.

In embodiments, the spring contacts 182 may include Ni barrier areas 582. In one or more embodiments, the spring contacts 182 may include a Nickel underlayer all over and, in embodiments, may include gold plating on the contact area and on the solder area. The various measurements specifications depicted in the figures are according to one or more embodiments. It should be understood, however, that the intention is not to limit the disclosure to the particular embodiments described FIGS. 20A-20B illustrate an embodiment of the conductor component/PCB 61 (dev. Board, add spring pads and angled laser pads). FIG. 20A shows a top view of component 61 and FIG. 20B shows a bottom view. In one or more embodiments, component 61 includes ground pads 161, which may be placed on the raw PCB. In embodiments, the placement of the ground pads 161 align with the placement of the spring contacts 182, as shown in FIGS. 18A-18B. In embodiments, conductor component/PCB 61 may include 2 ground pads 161. In one or more embodiments, may include 4 ground pads 161 corresponding and connecting with a set of 4 radially placed spring contacts 182.

In embodiments, the conductor component/PCB 61 may further include contact pads 261 for connection with the electronic or light/illumination device 104. In embodiments, pads 261 may be angled, as shown. The conductor component/PCB 61 may further include contact pads 361 for connection with the forward and rearward activation components 60A, 60B. In embodiments, as illustrated in FIGS. 18A-18B, a flex circuit may be used to connect the button board to the main PCB board, rather than wires.

Figure 17:
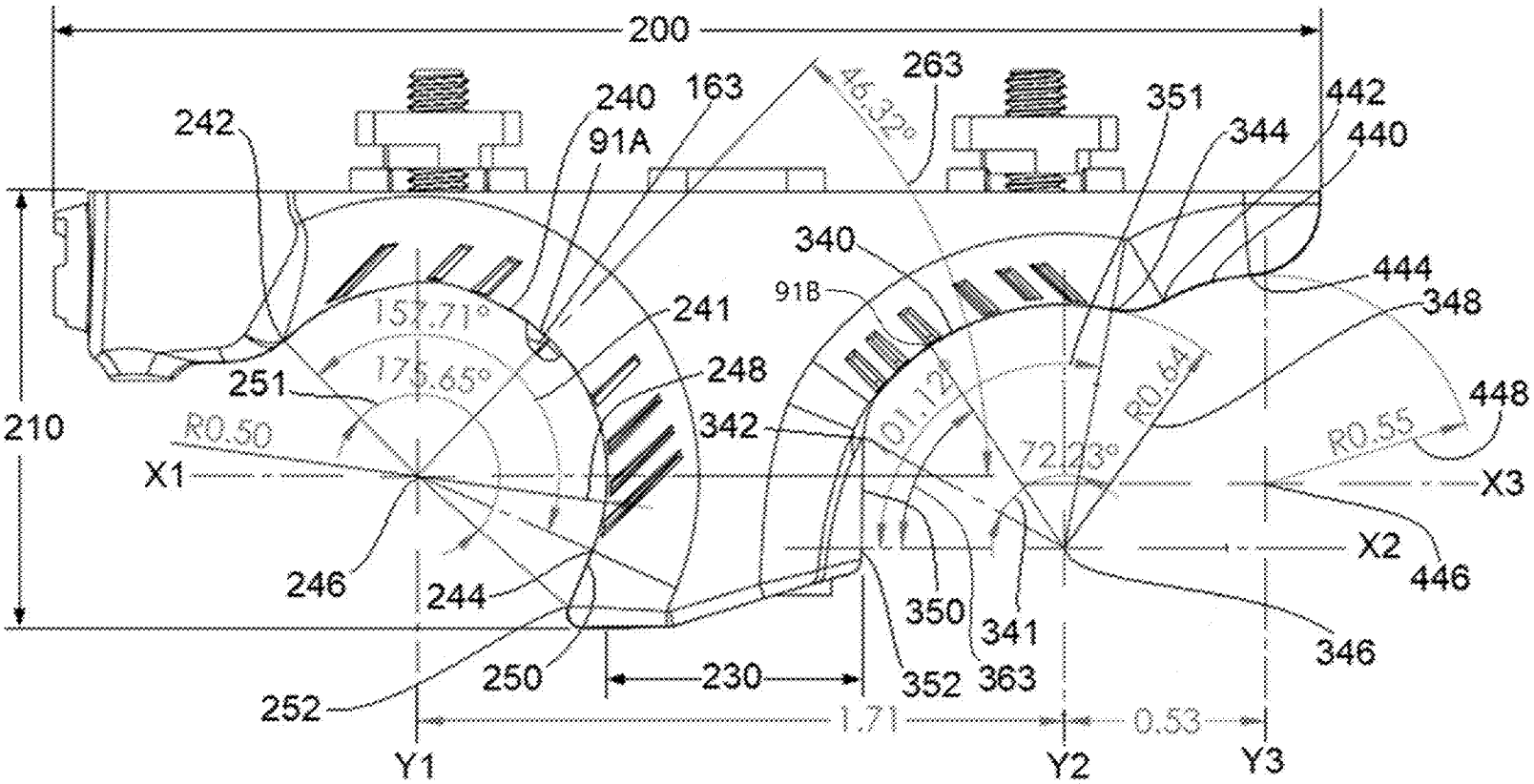
FIG. 17 depicts a left-side elevation view of an accessory device, according to one or more embodiments of the disclosure.

Referring to FIG. 17, a left-side elevation view of a device 12 with various measurements is depicted, according to one or more embodiments. In the embodiment shown, device 12, from a side profile perspective, forms a first forward arc 240 having an arc length from a forward end 242 to a rearward end 244. The first forward arc 240 has a positive curvature along its arc length relative to a center or center of curvature 246, which is the center of an imaginary circle having an x-axis X1 and a y-axis Y1 that best fits the curvature of the first forward arc 240, and a radius of curvature 248, which, similarly, is the radius of an imaginary circle or circular arc which best approximates the curve of the first arc 240. In embodiments, the first forward arc 240 subtends a first central angle 241 (also known as arc measure or arc angle) at center 246.

In the embodiment shown, device 12, from a side profile perspective, further forms a second forward arc 250 having an arc length from forward end 242 to a rearward end 252. In one or more embodiments, the second forward arc 250 has a positive curvature along its arc length and overlaps first forward arc 240 from forward end 242 to rearward end 244 relative to center of curvature 246, and thereafter decreasing to a zero curvature at rearward end 252. In one or more embodiments, the arc length of second forward arc 250 from rearward end 244 to rearward end 252 has a zero curvature substantially, and, in some embodiments, entirely, along its length. In one or more embodiments, the center of curvature of second forward arc 250 is positioned at, or substantially at, center 246, having radius of curvature 248, such that a center of an imaginary circle that best fits the curvature of the second forward arc 250 overlaps that of the first forward arc 240. In embodiments, the second forward arc 250 subtends a second central angle 251 (also known as arc measure or arc angle) at center 246. In one or more embodiments, rearward ends 242 and 252 may have about the same position.

In one or more embodiments, central angle 241 is about 157.71 degrees and central angle 251 is about 175.65 degrees. In one or more embodiments, radius of curvature 248 is about 0.50 inches.

In one or more embodiments, forward activator access opening 91A and at least a portion of forward activator 162, for example protrusion portion 163, are positioned along the first forward arc 240, forming a forward activator angle 263 at center 246, from the x-axis X1. In one or more embodiments, the forward activator angle 263 is about 46.32 degrees.

In the embodiment shown, device 12, from the side profile perspective, forms a first rearward arc 340 having an arc length from a forward end 342 to a rearward end 344. The first rearward arc 340 has a positive curvature along its arc length relative to a center or center of curvature 346, which is the center of an imaginary circle having an x-axis X2 and a y-axis Y2 that best fits the curvature of the first rearward arc 340, and a radius of curvature 348, which, similarly, is the radius of an imaginary circle or circular arc which best approximates the curve of the first arc 340. In embodiments, the first rearward arc 340 subtends a first central angle 341 (also known as arc measure or arc angle) at center 346.

In the embodiment shown, device 12, from a side profile perspective, further forms a second rearward arc 350 having an arc length from a forward end 352 to rearward end 344. In one or more embodiments, the second rearward arc 350 has a positive curvature along its arc length that overlaps first rearward arc 340 from forward end 342 to rearward end 344 relative to center of curvature 346, and a decreasing, zero or negative curvature from forward end 352 to forward end 342, relative to center of curvature 346. In one or more embodiments, the arc length of second rearward arc 350 from forward end 354 to forward end 352 has a zero or negative curvature substantially, and, in some embodiments, entirely, along its length. In one or more embodiments, the center of curvature of second rearward arc 350 is positioned at, or substantially at, center 346, with radius of curvature 348, such that a center of an imaginary circle that best fits the curvature of the second rearward arc 350 overlaps that of the first rearward arc 340. In embodiments, the second rearward arc 350 subtends a second central angle 351 (also known as arc measure or arc angle) at center 346. In one or more embodiments, rearward ends 342 and 352 may have about the same position.

In one or more embodiments, central angle 341 is about 72.23 degrees and central angle 251 is about 101.12 degrees. In one or more embodiments, radius of curvature 348 is about 0.64 inches.

In one or more embodiments, device 12 includes a rearward activation component 60B a rearward activator access opening 91B and at least a portion of rearward activator 162B, for example protrusion portion 163B, are positioned along the first rearward arc 340, forming a rearward activator angle 363 at center 346, from the x-axis X2. In one or more embodiments, the rearward activator angle 363 is about 56.00 degrees. 57.50 degrees In the embodiment shown, device 12, from the side profile perspective, forms a third rearward arc 440 having an arc length from a forward end 442 to a rearward end 444. The third rearward arc 440 has a positive curvature along its arc length relative to a center or center of curvature 446, which is the center of an imaginary circle having an x-axis X3 and a y-axis Y3 that best fits the curvature of the third rearward arc 440, and a radius of curvature 448, which, similarly, is the radius of an imaginary circle or circular arc which best approximates the curve of the third arc 440. In one or more embodiments, radius of curvature 448 is about 0.55 inches.

In one or more embodiments, axis Y1 is about 1.71 inches from axis Y2. In one or more embodiments, axis Y2 is about 0.53 inches from axis Y3. In embodiments, axis Y1 is about 1.71 inches from axis Y2 and axis Y2 is about 0.53 inches from axis Y3.

In one or more embodiments, device 12, may have a length 200 of about 6 inches or less and, in some embodiments, a length 200 of 5 inches or less. In some embodiments, the device 12 may have a length 200 of about 5 inches or less, a width 220 of about 1.03 inches or less and a height 210 of about 1.72 inches or less. In further embodiments, the device 12 may have a length 200 of about 4 inches or less, a width 220 of about 0.83 inches or less and a height 210 of about 1.38 inches or less. In still further embodiments, the device 12 may have length 200 of about 3.00 to about 3.67 inches, a width 220 of about 0.62 to about 0.76 inches and a height 210 of about 1.03 to about 1.26 inches. In one or more embodiments, the device 12 has a length 200 of about 3.34 inches, a width 220 of about 0.69 inches and a height 210 of about 1.15 inches.

In one or more embodiments, in combination with one or more of the length, width and height of the above measurements, respectively, the device 12 may have a minimum trunk length 230 of about 1.20 inches or less and, in some embodiments, a minimum trunk length 230 of 1.00 inch or less. In further embodiments, the device 12 may have a minimum trunk length 230 of about 0.80 inches or less, and, in still further embodiments, the device 12 may have a minimum trunk length 230 of about 0.60 to about 0.74 inches. In an embodiment, the device 12 may have a minimum trunk length 230 of about 0.67 inches.

In one or more embodiments, the device 12 may have length 200 of about 3.00 to about 3.67 inches, a width 220 of about 0.62 to about 0.76 inches, a height 210 of about 1.03 to about 1.26 inches and a minimum trunk length 230 of about 0.60 to about 0.74. In one or more embodiments, the device 12 has a length 200 of about 3.34 inches, a width 220 of about 0.69 inches, a height 210 of about 1.15 inches and a minimum trunk length 230 of about 0.67 inches.

With respect to dimensions and measurements, including distances, angles, curvatures and proportions (including ratios of element to element dimensions and/or measurements), (herein "Dimensions") of device 12, including elements, components and features thereof, given and/or shown above and herein, in one or more embodiments, the dimensions of device 12 are as shown in the figures. In one or more embodiments, the Dimensions of device 12 given and/or shown herein include the range of +1% of those specified and/or shown. In an embodiment, the Dimensions of device 12 given and/or shown herein include the range of +2% of those specified and/or shown, and, in a further embodiment, the range of +3% of those specified and/or shown.

In one or more embodiments, the Dimensions of device 12 given and/or shown herein include the range of +4% of those specified and/or shown, and in a further embodiment, the range of +5% of those specified and/or shown. In further embodiments, the Dimensions of device 12 given and/or shown herein include the range of +6%, 8%, 10%, 15% or 20%, distinctly, of those specified and/or shown.

In one or more embodiments, the device is compact and lightweight. In an embodiment, device 12 has a length of about 3.34 inches, a width of about 0.69 inches and a height of about 1.15 inches. In one or more embodiments, device 12 has a mass of about 12 g and may have a volume of about 12338 $mm^3$ and or a surface area of about 19112 $mm^3$.

With respect to the Dimensions herein, embodiments include any combinations of the given dimensions of device 12, including elements, components and features thereof.

The components herein may be conventionally formed of thermoplastic polymers by injection molding.

In one or more embodiments, body portion 26 is of an ergonomic design, having multiple gripping or engagement philosophies. As an example, user may employ a two finger wrap hold to pull weapon to shoulder or use the device as a hand/finger-stop, which has an effect of stopping the front hand from entering line of fire or combustion. The curvatures and trunk portion of the devices herein provide for comfortable and secure hand/finger engagement and the positioning of the activators allows for activation within the natural extension of the user's hand/fingers with minimal movement. The device provides for ambidextrous forward and/or rearward On/Off buttons, intuitive feel in activating the laser and aiming and handling of the weapon and quick target acquisition.

In one or more embodiments, features of the device 12 may include one or more of: a digital camera, a video camera with or without audio, instant-on camera activation (programmed and/or sensor triggered), microphone, adjustable tactical light, USB connectivity, password protection, and USB port(s) and system status indicator lights.

U.S. Pat. Nos. 10,532,275; 10,436,553; 10,436,538; 10,365,069; 10,323,903; 10,260,841; 10,222,171; 10,209,033; 10,209,030; 10,132,595; 10,060,701; 9,696,111; 9,658,031; 9,476,672; 9,182,194; 8,844,189; 8,807,779; 8,662,694; 8,595,970; 8,312,665; 8,182,109; 8,127,486; 8,127,485; 8,001,715; 7,827,726; 6,705,038; 6,571,503; 6,282,829; 6,219,952; 6,185,854; 5,905,238; 5,448,834; 5,446,535; 5,430,967; 5,241,146; 5,208,826; 4,894,941; 4,234,911; 4,232,867; 4,144,505; 3,992,783; 3,573,868; 3,526,972; 3,510,965; 3,284,905; 3,112,567; 2,904,888; 2,844,710; 2,780,882; 2,773,309; 2,430,469; 2,268,056; 1,898,566; D790651; D790650; D786384; D786383; D487791; D368121; D873946; and D672005 are hereby incorporated by reference herein in their entirety for all purposes. In addition, U.S. Publication Nos.: 2004/0244259; 2006/0204835; 2010/0178540; 2015/0184978; 2017/0155269; 2016/0061560; 2018/0106568; 2018/0238649; 2018/0299217; 2018/0321015; 2019/0063864; 2019/0222771; 2015/0233668; 2014/0355258; 2014/0109457; 2014/0007485; 2013/0185978: 2012/0144718; 20110047851; 2012/0144716; 2011/0138667; 2011/0107643; 2011/0074303; 2007/0039226; 2005/0130739; 2004/0003529; 2002/0134000; 2002/0129536; 2002/0073561; 2002/0057719; 2002/0009694; and 2001/0042335 are hereby incorporated by reference herein in their entirety for all purposes. Components illustrated in such patents may be utilized with embodiments herein. Incorporation by reference is discussed, for example, in MPEP section 2163.07 (B).

The patents, patent publications and other references mentioned above in all sections of this application are herein incorporated by reference in their entirety for all purposes. All of the features disclosed in this specification (including the references incorporated by reference, including any accompanying claims, abstract and drawings and the accompanying Appendix A), and/or all of the steps of any method or process so disclosed, may be combined in any combination, except combinations where at least some of such features and/or steps are mutually exclusive. The invention is not restricted to the details of the foregoing embodiment (s). The invention extends to any novel one, or any novel combination, of the features disclosed in this specification (including any incorporated by reference references, any accompanying claims, abstract and drawings), or to any novel one, or any novel combination, of the steps of any method or process so disclosed.

The descriptions of the various embodiments of the present disclosure have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

The invention claimed is:

1. A finger stop device for a firearm, comprising:

a housing removably attachable to the firearm, the housing having an axis through a forward end and a rearward end of the housing and comprising a body portion downwardly extending from a cover portion, wherein the body portion includes a trunk portion and forward and rearward portions oppositely extending from an upper portion of the trunk portion and a wall defining an inner chamber, the forward and rearward portions each having a tapered neck portion between the trunk portion and a forward end portion and a rearward end portion;

an aperture formed in the forward end of the housing;

an illumination device engaged by an internal seat disposed within the housing, the illumination device being configured to emit light through the aperture;

a first activation device accessible from outside of the housing, through the wall of the body portion, the first activation device being operably connected to the illumination device and a power supply, wherein engagement with the first activation device directs power from the power supply to the illumination device; and a coupling mechanism for coupling the housing to the firearm, wherein the forward, rearward and trunk portions each intersect a common plane.

2. The device of claim 1, wherein illumination device is a laser module.

3. The device of claim 1, wherein the common plane vertically bisects the device.

4. The device of claim 1, wherein the illumination device and aperture each intersect the common plane.

5. The device of claim 1, wherein the first activation device at least partially extends through a first opening in the wall of the body portion at an angle between the axis and a line through and perpendicular to the first opening in a range of about 35 degrees to about 55 degrees.

6. The device of claim 1, further comprising a second activation device accessible from outside of the housing, through the wall of the body portion, the second activation device being operably connected to the illumination device and a power supply, wherein engagement with the second activation device directs power from the power supply to the illumination device, wherein the first activation device intersects the common plane and is forwardly oriented and positioned in the wall of the body portion rearward of the forward tapered neck portion and the second activation device is rearwardly oriented and positioned in the wall of the body portion forward of the rearward tapered neck portion.

7. The device of claim 6, wherein the second activation device at least partially extends through a second opening in the wall of the body portion at an angle between the housing axis and a line through and perpendicular to the second opening in a range of 34 degrees to about 44 degrees.

8. The device of claim 1, wherein a conductor component is electrically connected to an inner sleeve by spring contacts.

9. The device of claim 8, the conductor component including angled contact pads for connection with the illumination device and/or contact pads for connection with the forward and/or rearward activation components.

10. A laser sighting device comprising:

a housing, the housing defining an inner chamber and having a trunk portion vertically oriented between an upper portion and a lower portion, a forward extending portion having a forward end portion and a neck portion and a rearward extending portion having a rearward end portion and a neck portion, wherein the neck portions are positioned between the forward and rearward end portions and the upper trunk portion, wherein, when viewed from a side profile perspective, the housing forms a first forward arc having an arc length from a forward end to a rearward end, the first forward arc having a positive curvature along its arc length relative to a forward center or forward center of curvature, wherein the forward center is the center of an imaginary circle having a first x-axis and a first y-axis that best fits the curvature of the first forward arc, and a forward radius of curvature, the forward radius of curvature being the radius of an imaginary circle or circular arc which best approximates the curve of the first forward arc, wherein the first forward arc subtends a first forward central angle at the forward center, wherein the forward central angle is in a range of about 150 to about 165 degrees or about 157.71 degrees;

an illumination device disposed within the inner; and a first activation component accessible from outside of the housing, through a forward activator access opening in the housing, the first activation device being operably connected to the illumination device and a power supply, wherein engagement with the first activation component directs power from the power supply to the illumination device.

11. The device of claim 10, wherein, when viewed from a side profile perspective, the device further forms a second forward arc having an arc length from forward end to a rearward end, the second forward arc having a positive curvature along its arc length and overlapping the first forward arc from its forward end to its rearward end relative to the forward center of curvature, thereafter decreasing to a zero curvature at a rearward end, wherein the a center of curvature of the second forward arc is positioned at, or substantially at, the forward center, the second forward arc subtending a second forward central angle at the forward center.

12. The device of claim 10, wherein the first forward central angle is in a range of about 147 degrees to about 167 degrees or about 152 to about 162 degrees or is about 157.71 degrees and the second forward central angle is in a range of about 165 to about 185 degrees or about 170 to about 180 degrees or is about 175.65 degrees.

13. The device of claim 10, the device further comprising a second activation component accessible from outside of the housing, through a rearward activator access opening in the housing, the second activation device being operably (electrically) connected to the illumination device and a power supply, wherein engagement with the second activation component directs power from the power supply to the illumination device.

* * * * *